United States Patent [19]

Erdman

[11] Patent Number: 4,720,557

[45] Date of Patent: Jan. 19, 1988

[54] PROCESS FOR PRODUCING A COMPOSITION COMPRISING 1,3,5-TRIOXANE AND METHODS FOR USING SAID COMPOSITION

[75] Inventor: J. Gordon Erdman, Bartlesville, Okla.

[73] Assignee: Phillips Petroleum Company, Bartlesville, Okla.

[21] Appl. No.: 781,627

[22] Filed: Sep. 30, 1985

Related U.S. Application Data

[62] Division of Ser. No. 610,227, May 14, 1986, Pat. No. 4,595,396.

[51] Int. Cl.[4] ..... C07D 323/06; C07D 319/06

[52] U.S. Cl. ..... 549/368

[58] Field of Search ..... 44/51, 53; 549/368

[56] References Cited

U.S. PATENT DOCUMENTS

| | | | |
|---|---|---|---|
| 1,657,815 | 1/1928 | Bates | 44/51 |
| 1,657,961 | 1/1928 | Flores | 44/51 |
| 2,119,110 | 5/1938 | McCaffrey | 44/9 |
| 2,331,158 | 10/1943 | Arundale et al. | 44/47 |
| 2,465,489 | 3/1949 | Sokol | 549/368 |
| 2,552,737 | 5/1951 | Rees | 48/214 |
| 2,916,366 | 12/1959 | Heinrich et al. | 44/56 |
| 3,149,127 | 9/1964 | Platz | 260/340 |
| 3,318,955 | 5/1967 | Gerloff et al. | 260/603 |
| 3,347,869 | 10/1967 | Flodin et al. | 549/368 |
| 3,580,928 | 5/1971 | McAndrew et al. | 260/340 |
| 3,661,932 | 5/1972 | Pregaglia et al. | 549/368 |
| 3,732,252 | 5/1973 | Komazawa | 549/368 |
| 3,933,446 | 1/1976 | Timmins | 48/197 |
| 3,968,999 | 7/1976 | Keller | 302/66 |
| 4,045,092 | 8/1977 | Keller | 44/51 |
| 4,054,609 | 10/1977 | Osugi | 260/603 |
| 4,093,029 | 6/1978 | Weisz et al. | 166/305 |
| 4,175,115 | 11/1979 | Ball et al. | 423/415 A |
| 4,340,542 | 7/1982 | Bär et al. | 549/368 |
| 4,345,972 | 8/1982 | Hannebaum et al. | 203/18 |
| 4,346,179 | 8/1982 | Sugier et al. | 518/707 |
| 4,381,397 | 4/1983 | Yoshida et al. | 549/368 |
| 4,504,670 | 3/1985 | Voight et al. | 549/368 |

FOREIGN PATENT DOCUMENTS

| | | | |
|---|---|---|---|
| 0164680 | 12/1980 | Japan | 549/368 |

OTHER PUBLICATIONS

"Coal/Liquid $CO_2$ Slurry Pipeline Under Study." *Oil & Gas Journal* (Jan. 23, 1984), p. 30.

Benemann, J. R. et al. "A Systems Analysis of Bioconversion with Microalgae." *In Symposium Papers, Clean Fuels from Biomass and Wastes,* Jan. 25–28, 1977, sponsored by Institute of Gas Technology, pp. 102–126.

Meinhold, G. and G. Loading, "Offshore Methanol Plant Offers Outlet for Associated Gas." OGJ Report (May 2, 1983) pp. 116–124.

Shrartsburd, Vladmir. "Here Are Important Criteria for Designing Coal-Slurry Pipelines," *Technology,* (Nov. 7, 1983), pp. 91–95.

Davis, John C. "Long-Distance Slurry Transport Finally in the Pipeline?" *Chemical Engineering* (Apr. 12, 1976) pp. 67–70.

Hagar, R. and P. Hart. "Railroad Opposition, Coal Market Slump Stall U.S. Slurry Pipelines." *Oil & Gas Journal* (Aug. 22, 1983), pp. 57–62.

*The Chemical Process Industries,* Shreve, R. N., 2nd ed., McGraw-Hill Book Co., Inc., N.Y., 1956, pp. 80, 121, 831.

*Chemistry, Inorganic & Organic with Experiments,* Bloxam, C. L., 10th ed., P. Blakiston's Son & Co., Philadelphia, 1913, 270, 592, 593.

*Primary Examiner*—William R. Dixon, Jr.
*Assistant Examiner*—Margaret B. Medley
*Attorney, Agent, or Firm*—Williams, Phillips and Umphlett

[57] ABSTRACT

Novel compositions comprising methanol and 1,3,5-trioxane, uses as slurry agents and/or fuels, and methods of synthesis of said compositions from gases containing carbon dioxide and light hydrocarbons are disclosed.

8 Claims, 4 Drawing Figures

PROCESS FOR PRODUCING A COMPOSITION COMPRISING 1,3,5-TRIOXANE AND METHODS FOR USING SAID COMPOSITION

This is a divisional of pending application Ser. No. 610,227, filed May 14, 1984 now U.S. Pat. No. 4,595,396.

BACKGROUND OF THE INVENTION

This invention relates to a novel composition. In one aspect, this invention relates to processes to make said composition. In still another aspect, this invention relates to uses of said composition.

Light hydrocarbons are commercially significant as fuels, and as chemical intermediates in numerous industrial and domestic applications. Many gases which are potential sources of light hydrocarbons also contain carbon dioxide. For instance, subterranean deposits of natural gas frequently contain carbon dioxide along with light hydrocarbons such as methane, ethane, propane, butane and the like. If the carbon dioxide content of the natural gas is too high, then the gas will have little or no commercial value as fuel. The use of the gas will determine whether or not a given concentration of carbon dioxide is considered as high. For instance, where the gas is used as a town gas for home heating, the fuel value which represents the thermal energy per unit volume of gas must meet specific standards. If the gas contains too much carbon dioxide, then the energy content of the gas will be inadequate for the intended use. In industrial uses such as boilers and furnaces, a fuel value that is less than the fuel value of a town gas may be acceptable. However, gases with only twenty to thirty volume percent methane or the like based on total volume of gas have an extremely poor fuel value and are frequently not commercially acceptable for any use as a fuel.

Gases that have a relatively high carbon dioxide content and a relatively low content of light hydrocarbon generally have not been commercially utilized as fuels. The costs of separating the carbon dioxide from the light hydrocarbon are often prohibitive. Furthermore, major deposits of carbon dioxide-rich natural gas have been found offshore and in other remote locations. For example, it has been reported that large natural gas reserves in certain Siberian fields contain about 15 volume percent carbon dioxide and about 85 volume percent methane. Also, large deposits of natural gas found in the South China Sea are said to contain only about twenty volume percent methane and contain about eighty volume percent other constituents, of which carbon dioxide is reported to be the most abundant.

The transportation of a gas containing a light hydrocarbon from a remote source to a market poses technical and economical problems. For instance, there are presently three major modes for transporting gas containing a light hydrocarbon. These are gas pipelines, condensation of the gas to a low temperature liquid and transporting the refrigerated liquid by pipeline or vessel, and partial oxidation of the light hydrocarbon in the gas with air to produce methanol which can be transported by pipeline or vessel in liquid form without refrigeration. All of these modes are in commercial use, but are useful only under certain circumstances or have serious problems associated with their use.

Significant problems are incurred with transportation of light hydrocarbons by condensation and transportation as liquids. Liquid methane, for instance, has a low density and an extremely low boiling point. Boiling at −161.5° C. at atmospheric pressure, liquid methane is generally transported in heavily insulated tankers, the cargo capacities of which are small compared to the size and cost. Liquid methane has a density of only about 0.415 $g.cm^{-3}$ compared to a density of 0.8 for a medium light crude oil. Thus a barrel of cargo capacity will transport only about 146 lbs of liquid methane compared to about 300 lbs of crude oil.

Likewise the conversion of light hydrocarbons into methanol for transportation faces serious problems, even though methanol is a liquid which can be transported in conventional tankers and pipelines. For example, the current conversion of methane to methanol through controlled oxidation with air has several disadvantages. The partial oxidation reaction is exothermic and results in a loss of about 18.4% of the potential thermal energy of the methane. This loss represents about 1.08 million B.T.U. per equivalent barrel of crude oil, assuming that approximately 6,000 cu. ft. of methane is equivalent in potential energy to a barrel of crude oil. Also, methanol has a relatively low density, 0.7865 at 25° C. Thus, more tanker volume is required to transport methanol as cargo as compared to denser liquids. Methanol also has a low heating value, 2.7 million B.T.U. per barrel versus 6.0 for crude oil.

In addition to problems associated with transporting, a gas presents storage problems also. These problems are incurred at the well head production source and at the location where the gas is used. Vast storage tanks adequate to accommodate large volumes of gas are often not available.

The transportation of solids or very viscous materials also presents technical and economic problems. Like natural gases, difficult to handle solid fuels such as coal, wood chips, and plant matter often have a source that is a great distance from a market. Some solid fuels are bulky and do not lend themselves well to some conventional modes of transportation unless they are combined with a liquid to form a slurry. Viscous bituminous mixtures such as asphaltic crudes, residual fuel oils, shale oils and tar sand extracts are akin to solid fuels in that they cannot easily be transported, since they cannot be pumped or otherwise moved, without heating and/or admixing with a dispersing agent or diluent. They can thus be considered equivalent to a solid fuel.

Many different slurry agents have been used with solid or viscous fuels. Coal, for instance, has been combined with water and with methanol. Slurrying coal with water presents numerous problems. The supply of water at many sources of coal is limited. Some states have passed laws forbidding the use of water to slurry coal for pipeline transport. There are a great many practical reasons for not pumping water along with coal from an area that has a limited water supply. Also, coal suspended in water easily separates. Thus upon any flow interruption, coal can settle out and block lines, valves, pumps, etc. A more stable slurry is needed. Coal that is too wet cannot be burned directly as a fuel. A certain amount of the water slurry agent must be separated from the coal and be disposed of. The disposal of a water slurry agent for coal can cause pollution problems. Water can pick up various contaminants such as iron, sulfur, or selenium from the coal. Solid fuels have also been combined with methanol. Methanol when used alone as a slurry agent can be very expensive, expecially when the source of the methanol is a great distance from the source of the solid fuel.

The need for solutions to these problems increases with the demand for alternate sources of energy.

SUMMARY OF THE INVENTION

One object of this invention is the recovery and transport of the energy values contained in mixtures of one or more light hydrocarbons with a substantial portion of carbon dioxide.

It is thus one object of this invention to provide a process to produce a composition of trioxane and a solvent comprising at least one alcohol, e.g., methanol, from a gas containing a light hydrocarbon.

Another object of this invention is to provide a composition of trioxane and methanol produced from a gas that has a relatively high carbon dioxide content and a relatively low content of light hydrocarbon.

A still further object of this invention is to utilize a composition of methanol and trioxane in a process for the conversion and transportation of the heating value of a natural gas containing a light hydrocarbon and carbon dioxide.

Another object of this invention is a new and useful slurry agent for the transportation of viscous bituminous mixtures, such as asphaltic crudes, residual fuels and/or solid fuels.

Still another object of this invention is to provide a slurry agent for use with solid or viscous fuels which can itself be consumed as a fuel with the solid or viscous fuels or can be separated therefrom and used independently as a fuel for domestic uses, industrial purposes, or in internal combustion or other engines.

Another object of this invention is a composition which can be cracked into a hydrogen rich synthesis gas that can be used in the manufacture of nitrogen and carbon based compounds.

In accordance with this invention, novel compositions are provided comprising 1,3,5-trioxane and a solvent comprising a major portion of at least one alcohol, preferably an alcohol having from 1 to about 6 carbon atoms, and most preferably, a major portion of methanol, and at least one further ingredient selected from the group consisting of water, polar organic compounds, light hydrocarbons and aromatic hydrocarbons. This further ingredient is present in a minor amount effective to depress the crystallization temperature of the trioxane in the solvent phase. The polar organic compounds which can be used include ethers, aldehydes, ketones and the like, but exclude alcohols, since the major portion of the solvent comprises at least one alcohol. The minor but effective amount will generally be in the range of from about 2 to about 20 weight percent, or preferably from about 5 to about 15 weight percent, of the total composition. Although the invention will be discussed primarily in terms of preferred embodiments which involve methanol as the alcohol, any suitable alcohol having 1 to about 6, or preferably from 1 to about 4 carbon atoms can be used in various embodiments, therefore the disclosure in terms of methanol should not be taken to limit the invention. These compositions can be used as fuels, vehicles for transporting the hydrocarbon heating values, or as slurry agents for solid or viscous fuels.

In accordance with another embodiment of this invention, processes for increasing the energy density of a mixture of light hydrocarbons and carbon dioxide are provided, comprising such steps as: (a) reacting a light hydrocarbon with carbon dioxide and oxygen to form a synthesis gas comprising carbon monoxide and hydrogen, (b) reacting said carbon monoxide and hydrogen to form a synthesis gas reaction product comprising methanol and formaldehyde, and (c) trimerizing said formaldehyde to trioxane.

In another embodiment, a synthesis gas comprising carbon monoxide and hydrogen is obtained from a source such as the gasification of coal, and is converted to a product comprising methanol and formaldehyde, with the formaldehyde thereafter trimerized to trioxane and used in a composition of trioxane and methanol.

These and other objects, advantages, details, features and embodiments of this invention will become apparent to those skilled in the art from the following detailed description, the appended claims, and the drawings.

BRIEF DESCRIPTION OF THE DRAWING

FIG. 2 illustrates a process for production of a composition of methanol and trioxane from starting materials of carbon dioxide and a light hydrocarbon, in which the hydrogen and carbon monoxide components of a synthesis gas formed from said carbon dioxide and light hydrocarbon are converted to both methanol and formaldehyde in a single synthesis gas reactor.

FIG. 3 illustrates an alternative process for production of a composition of trioxane and methanol in which the synthesis gas reactions to form formaldehyde and methanol are carried out in two separate reactors, rather than the single reactor of FIG. 2, with a mixture of formaldehyde and methanol being formed in the formaldehyde reactor.

FIG. 4 illustrates another process for production of a composition of methanol and trioxane in which the reactions for the formation of methanol and formaldehyde are carried out in separate reactors, as in FIG. 2, with the formaldehyde being formed from methanol.

DETAILED DESCRIPTION OF THE INVENTION

The term "light hydrocarbon" as used in the specification and claims refers to aliphatic compounds having from 1 to about 6 carbon atoms, such as methane, ethane, propane, butanes, pentanes and hexanes, and also to cyclic and/or unsaturated compounds having up to about 6 carbon atoms which are constituents of petroleum, such as cyclopentane, cyclohexane, ethylene, butylene and the like.

In one embodiment of this invention, a liquid composition comprising methanol and trioxane is obtained. In other embodiments, other alcohols such as ethanol can be used, admixed with methanol or other suitable alcohols. The compound 1,3,5-trioxane is commonly referred to as trioxane or α-trioxymethylene. Trioxane as used herein is a cyclic trimer of formaldehyde having the structural formula below:

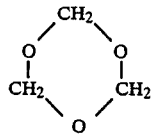

The process of dissolving trioxane in methanol has been found to be endothermic and thus the solubility of trioxane in methanol increases with increasing temperature.

In accordance with this invention, light hydrocarbons and carbon dioxide are converted by appropriate processes to trioxane, which can be utilized dissolved or slurried in a solvent comprising a major portion (i.e. at least 50 weight percent of the solvent) of at least one alcohol having from 1 to about 6 carbon atoms, preferably having from 1 to about 4 carbon atoms when a solution is desired. In various embodiments, the methanol or other alcohols and the trioxane can be formed concurrently, in the same process or reaction mixture, or in separate reaction mixtures. Methanol is the preferred alcohol, since it can be produced from the light hydrocarbons and carbon dioxide as part of the process and is an effective solvent for the trioxane. However, other available alcohols, particularly ethanol, can be used as components of the solvent.

Figure 1:
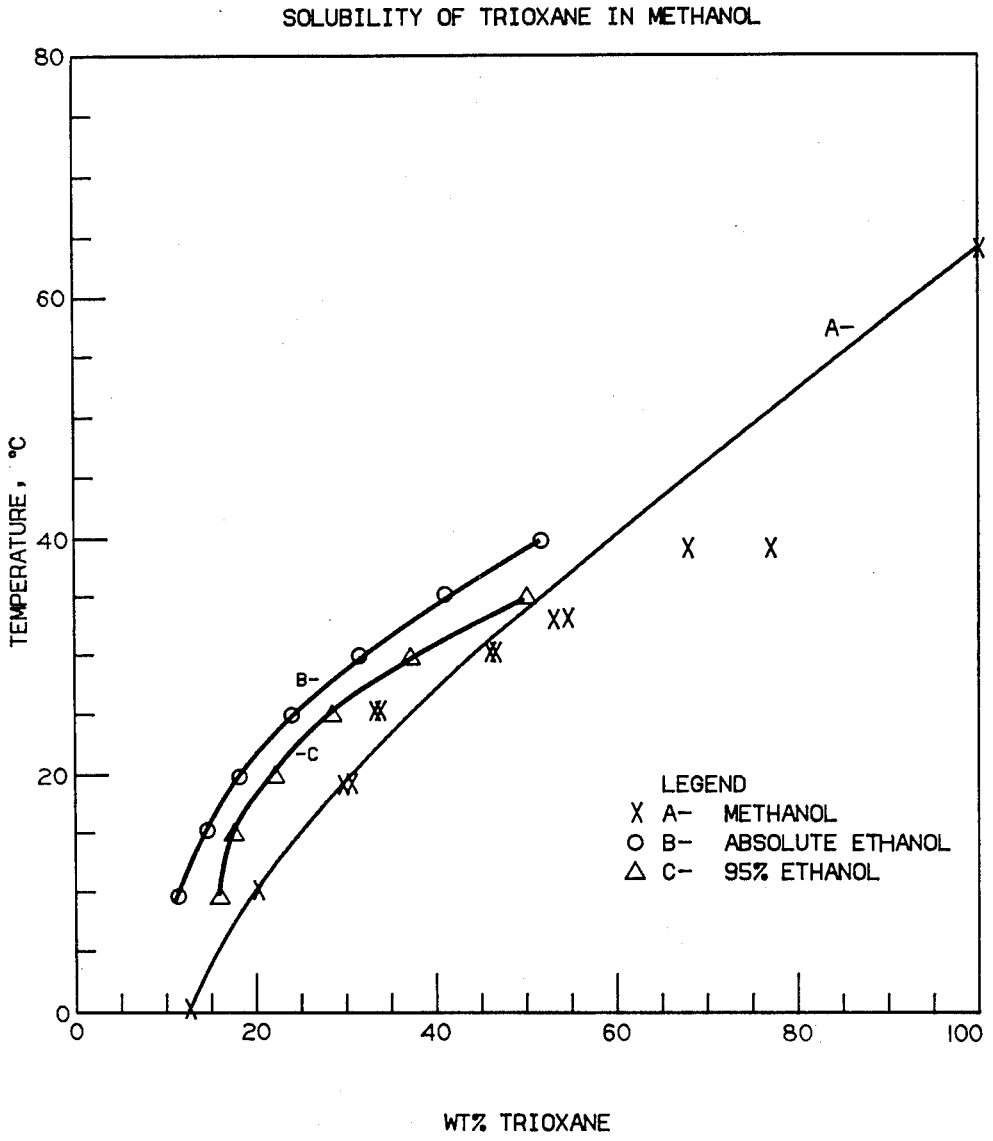
FIG. 1 shows data relating to the solubility of trioxane in methanol, absolute ethanol, and 95% ethanol, at various temperatures.

FIG. 1 shows the experimentally determined solubility of chemically pure trioxane in chemically pure methanol in curve "A". Table I below summarizes the data presented in FIG. 1.

TABLE I

SOLUBILITY OF TRIOXANE IN METHANOL

| Temperature, °C. | Wt. % Trioxane in Liquid Phase |
|---|---|
| 0.1 | 13.7 |
| 0.1 | 13.7 |
| 10.2 | 21.2 |
| 10.2 | 21.0 |
| 18.9 | 31.5 |
| 18.9 | 30.6 |
| 25.1 | 34.2 |
| 25.1 | 34.7 |
| 30.1 | 47.3 |
| 30.1 | 46.8 |
| 33.1 | 55.2 |
| 33.1 | 53.6 |
| 39.1 | 77.4 |
| 39.1 | 68.3 |
| 64.0 (melting point) | 100.00 |

The solubility of chemically pure trioxane in absolute ethanol and 95 percent ethanol was also determined experimentally, and calculated for the temperatures indicated in Tables II and III. These data are also plotted in FIG. 1, curves "B" and "C".

TABLE II

SOLUBILITY OF TRIOXANE IN ABSOLUTE ETHANOL

| Temperature, °C. | Wt. % Trioxane in Liquid Phase |
|---|---|
| 10 | 11.5 |
| 15 | 14.5 |
| 20 | 18.7 |
| 25 | 24.8 |
| 30 | 32.4 |
| 35 | 41.5 |
| 40 | 51.9 |
| 45 | (too high to accurately determine) |

TABLE III

SOLUBILITY OF TRIOXANE IN 95% ETHANOL, 5% $H_2O$

| Temperature, °C. | Wt. % Trioxane in Liquid Phase |
|---|---|
| 10 | 16.0 |
| 15 | 17.9 |
| 20 | 22.5 |
| 25 | 28.1 |
| 30 | 36.7 |
| 35 | 50.0 |
| 40 | (too high to accurately determine) |

Although these data indicate that the solubility of trioxane in absolute or 95 percent ethanol is slightly less at a given temperature than the solubility of trioxane in methanol, these solvents can be used as major or minor portions of the solvent in trioxane-methanol compositions. Comparison of curves "B" and "C" indicate that the addition of water to ethanol increases the solubility of trioxane at a given temperature, or in other terms, reduces the temperature at which a solution of a given concentration can be maintained without crystallization of the solute trioxane. It is expected that the same effect would be obtained by adding water to a methanol-trioxane solution.

Unless stated otherwise, the term "weight percent" as used in the specification and claims refers to percent by weight based on the total weight of the composition, whether it is a slurry or a solution.

Although the solubility of trioxane is expressed as weight percent of the solvent or liquid phase of a trioxane-alcohol composition, the proportions of trioxane, alcohol(s) and other ingredients in admixture are preferably expressed as parts by weight to avoid ambiguities as to the trioxane content of solutions and slurries.

For storage or shipment of a composition of trioxane in methanol as a homogeneous liquid, the concentration of the trioxane in the mixture should be less than the equilibrium value at the ambient temperature in accord with the data in Table I and FIG. 1 unless the composition is heated by means of heated storage tank, heated pipeline, the heat added in pipeline transport of the fluid caused by friction from fluid flow or pumps, or the like.

COMPOSITIONS OF METHANOL AND TRIOXANE

A bi-component composition of methanol and trioxane conveniently used in transportation can range from about 10 weight percent trioxane and about 90 weight percent methanol at about −5° C. to about 60 weight percent trioxane and about 40 weight percent methanol at about 40° C. Higher concentrations of trioxane in methanol and higher transportation temperatures can be used if desired. Preferably, a composition of methanol and trioxane is used in transport at a concentration in the range of from about 15 weight percent trioxane in methanol at about 0° C. to about 45 weight percent trioxane in methanol at about 30° C. Trioxane can thus be present in a solubilized amount in methanol at a temperature of the composition ranging from about 0° C. to about 30° C. Most preferably, a composition of methanol and solubilized trioxane used in transport can be about 40 to about 44 weight percent trioxane in methanol at about 23° to about 27° C., representing the most common ambient conditions. Other alcohols can be present in the composition.

To achieve the maximum density, thus the maximum fuel value (BTU) per unit volume, it is desirable to use the highest concentration of trioxane in methanol which is practicable under operating conditions. Trioxane crystals are plastic rather than hard and brittle. Thus, a trioxane-methanol solution containing such crystals could be pumped as a slurry, and with, e.g., heated storage tanks the heat value per unit volume could be maximized by preparing a solution in which some trioxane crystallizes out at storage temperature, then heating and/or agitating to dissolve the crystals prior to transport and/or use. However, when the solution is to be used as a motor fuel, it is undesirable to risk crystallization of the trioxane from the methanol solvent, unless the composition can be heated, directly or by pumping.

If no means for heating and/or agitation are available, trioxane concentrations too near the saturation point at the expected minimum temperature should be avoided, so that crystallization will not cause problems if the temperature goes lower than expected.

As shown in FIG. 1 for ethanol, if a composition of methanol and trioxane contains a minor amount, e.g. up to about 10 percent, water, the temperature at which saturation is reached and crystallization of trioxane begins can probably be advantageously depressed about 5° C. The resulting solubility of trioxane will be greater than that in pure methanol at any given temperature. For instance, a 42 weight percent trioxane in methanol composition can be kept a single phase liquid down to about 22° C. by the addition of 10 percent water. Thus a mixture containing 38.3 percent trioxane, 52.7 percent methanol and 10 percent water will be a stable liquid at a temperature from about 22° C. to about 27° C. and higher. To achieve a similar liquid stability with methanol alone would require the trioxane concentration be decreased to about 32 percent by weight. The trioxane content-temperature range can thus be broadened to, e.g., 10 weight percent trioxane in methanol and water at about −20° C. to about 70 weight percent trioxane at about 40° C.

Polar organic liquids such as aldehydes, ketones or ethers and light hydrocarbons comprising aromatics, e.g., benzene and toluene, and the normal hydrocarbons such as n-pentane and n-hexane can be used in a similar manner to depress the temperature at which saturation is reached, in lieu of or in conjunction with water. Since it is desirable to maximize the concentration of trioxane in methanol or mixtures of methanol with other alcohols for given operating conditions, thus obtaining the greatest density and fuel value (BTU per unit volume), when such liquids are available it may be appropriate to use them as minor portions of the composition, even though they are more expensive than water. The use of hydrocarbons or polar organic liquids rather than water is also advantageous in that they add fuel value, and even improve fuel quality, e.g., octane number, especially if the trioxane-methanol composition is to be used as a motor fuel.

Thus, one embodiment of the invention is a composition consisting essentially of an amount in the range of from about 40 to about 60 weight percent 1,3,5-trioxane at least partially dissolved in a solvent phase which consists essentially of a major portion of at least one alcohol and at least one further ingredient selected from the group consisting of water, polar organic compounds, light hydrocarbons and aromatic hydrocarbons in a minor amount effective to depress the crystallization temperature of the trioxane in the solvent phase. The alcohol can have from 1 to about 6 carbon atoms, preferably from 1 to about 4 carbon atoms, and is most preferably methanol.

In a preferred embodiment the composition comprises about 100 parts by weight of at least one alcohol, from about 40 to about 150 parts by weight of trioxane, and a minor amount in the range of from about 2 to about 20 parts by weight of at least one further ingredient selected from the group consisting of water, polar organic compounds, light hydrocarbons and aromatic hydrocarbons, effective to depress the crystallization temperature of the trioxane in the solvent phase. The composition preferably consists essentially of methanol, trioxane and at least one further ingredient as recited above.

In one variation of this embodiment, a stable near-saturated solution of trioxane and methanol containing 41.2 percent by weight of trioxane and 58.8 percent by weight of methanol was prepared. This composition of trioxane and methanol had a density of 0.908 g. $cm^{-3}$ at 30° C. and 0.9129 $g.cm^{-3}$ at 25° C. (calculated) as compared to a density of 0.7865 at 25° C. for methanol. The vapor pressure of the solution containing 41.2 percent by weight trioxane in methanol has been found experimentally to be represented by the equation:

$$\ln P = 1.91448\times10^{2} - 1.04912\times10^{4}T^{-1} + 3.49254\times10^{-2}T + -2.957718 \ln T$$

where P equals the vapor pressure in atmospheres and T equals the temperature in degrees Kelvin. Methanol alone, on the other hand, has a vapor pressure represented by the equation:

$$\ln P = 6.569653\times10^{2} - 2.2051278\times10^{3}T^{-1} + 1.7976\times10^{-1}T - 1.120456\times10^{2} \ln T$$

where P and T have the same meanings referred to above. These vapor pressure equations were derived from plotted experimental data by a standard four-parameter curve fitting technique.

The vapor pressure of the composition of methanol and trioxane is lower than the vapor pressure of methanol alone. The density of the composition is much greater than the density of methanol alone. The higher density and lower vapor pressure of the composition of methanol and trioxane allow more efficient transportation of the composition as compared with transportation of methanol alone. Transportation of a greater amount of fuel value per unit volume with less loss to evaporation results. For instances, by converting methane and carbon dioxide to a composition having 41.2 percent by weight trioxane in methanol, a 19% increase in physical efficiency in the transportation of methane is obtained over the prior art method of transporting methane by converting it to methanol.

SYNTHESIS OF METHANOL AND TRIOXANE

In another embodiment of this invention, methanol and trioxane are produced from a feedstream comprising a light hydrocarbon and carbon dioxide. A composition of methanol and trioxane can be produced from a feedstream such as a natural gas containing a relatively low amount of a light hydrocarbon and a relatively high amount of carbon dioxide.

The conversion of a light hydrocarbon and carbon dioxide to a methanol-trioxane composition is preferably carried out via intermediate steps. The $\Delta G_r$ for the process:

$$3/2CH_{4(gas)}+3/2CO_{2\ gas}\rightarrow C_3H_6O_{3\ (solid)}$$

which represents the direct conversion of methane and carbon dioxide to trioxane, is calculated to be +76.34 K cal $mol^{-1}$ at 298.15° K. and 1 atmosphere and −64.0 K cal $mol^{-1}$ at 298.15° K. and 1000 atmospheres total pressure. The term "$\Delta G_r$" as used herein refers to a calculated Gibbs free energy. The "$\Delta G_r$" is a parameter of process thermodynamics. If the "$\Delta G_r$" is positive and large at specific process conditions, then the process thermodynamics are unfavorable and the reaction is not likely to occur at those conditions; conversely, large negative values indicate favorable reaction conditions.

In one variation of this embodiment, a light hydrocarbon is reacted with carbon dioxide and oxygen to form a synthesis gas, comprising primarily carbon monoxide and hydrogen. The carbon monoxide and hydrogen components of the synthesis gas can then be reacted to form methanol and formaldehyde. The formaldehyde can then be trimerized in the absence of methanol to form trioxane. The trioxane so formed can then be admixed with methanol in a desired ratio to form a composition of methanol and trioxane. Preferably, the formaldehyde is trimerized to trioxane in the presence of methanol to form a methanol-trioxane composition.

In another variation of this embodiment, a light hydrocarbon, carbon dioxide, and oxygen are reacted to form a synthesis gas comprising primarily carbon monoxide and hydrogen as above. A first portion of the carbon monoxide and hydrogen components of said synthesis gas is reacted to form a first synthesis gas reaction product comprising substantially methanol. The methanol can be formed in the presence of a second portion of said synthesis gas comprising carbon monoxide and hydrogen. The second portion of carbon monoxide and hydrogen can be residual or unreacted carbon monoxide and hydrogen. The carbon monoxide and hydrogen components of the second portion of the synthesis gas are then reacted to form a second synthesis gas reaction product comprising formaldehyde. The second synthesis gas reaction product comprising formaldehyde can be formed in the presence of the first synthesis gas reaction product comprising methanol. The formaldehyde so formed can be trimerized to form trioxane, in the presence or absence of the methanol. A composition of methanol and trioxane can be formed either by trimerizing the formaldehyde to trioxane in the presence of the methanol or adding methanol to the trioxane product of formaldehyde trimerization.

In another variation, the synthesis gas comprising carbon monoxide and hydrogen is reacted to form a synthesis gas reaction product comprising methanol. At least a first portion of the methanol so formed is reacted to form formaldehyde. The formaldehyde so formed is trimerized to form trioxane. A second portion of the methanol can be admixed with trioxane formed to form a methanol-trioxane composition. Preferably the formaldehyde is formed from the first portion of the methanol and then can be trimerized to trioxane in the presence of the second portion of methanol. In all these systems, reaction conditions should be chosen to optimize the production of the cyclic trimer trioxane rather than the linear polymer, paraformaldehyde.

To carry out this invention, plant equipment to carry out the necessary reactions should preferably be provided at the remote site where natural gas or another source of carbon dioxide and hydrocarbon is available. For example, such a plant could be provided on an offshore platform placed near an oil or gas well.

The chemistry of the above described variations can be represented by the following equations, wherein methane is used as an exemplary light hydrocarbon. This inventive reaction sequence is not limited to methane, but is applicable to other light hydrocarbons, as heretofore described.

$$CH_{4(gas)}+CO_{2(gas)}\rightarrow 2CO_{(gas)}+2H_{2(gas)} \quad (I)$$

$$2CH_{4(gas)}+O_{2(gas)}\rightarrow 2CO_{(gas)}+4H_{2(gas)} \quad (II)$$

$$CO_{(gas)}+2H_{2(gas)}\rightarrow CH_3OH_{(gas)} \quad (III)$$

$$CO_{(gas)}+H_{2(gas)}\rightarrow CH_2O_{(gas)} \quad (IV)$$

$$3CH_2O_{(liquid)}\rightarrow C_3H_6O_{3(solid)} \quad (V)$$

The reaction of methane and carbon dioxide to form carbon monoxide and hydrogen, Reaction (I) above, is favored by high reaction temperatures. A calculated $\alpha G_r$ for Reaction (I), is +7.72 K cal $mol^{-1}$ at 800° K. and 1 atmosphere, but the $\alpha G_r$ for Reaction (I) is −5.89 K cal $mol^{-1}$ at 1000° K. and 1 atmosphere. Reaction (II) is highly exothermic. The $\alpha G_r$ for Reaction (II) at 1000° K. and 1 atmosphere is −52.56 K cal $mol^{-1}$. The reactions of carbon monoxide and hydrogen to form methanol, Reaction (III) and formaldehyde, Reaction (IV), are favored by low, rather than high temperatures and by high pressures. The calculated $\alpha G_r$ for Reaction (III) is −6.0 K cal $mol^{-1}$ at 298.15° K. and 1 atmosphere and the $\alpha G_r$ is −11.5 K cal $mol^{-1}$ at 298.15° K. and 100 atmospheres. The calculated $\alpha G_r$ for Reaction (IV) is +4.2 K cal $mol^{-1}$ at 298.15° K. and 1 atmosphere and is +1.5 K cal $mol^{-1}$ at 298.15° K. and 100 atmospheres. Reaction (III) and Reaction (IV) can occur simultaneously in the same reactor.The subsequent trimerization of formaldehyde to trioxane, Reaction (V), can occur in the presence or absence of methanol. Reaction (V) is favored by low temperatures and high pressures. The calculated $\alpha G_r$ is −4.46 K cal $mol^{-1}$ at 298.15° K. and 1 atmosphere and is −12.6 K cal $mol^{-1}$ at 298.15° K. and 100 atmospheres. The product of Reaction (V) is a solid at room temperature (15°-25° C.) and atmospheric pressure The general overall stoichiometric equation for a process represented by Reactions (I), (II), (III), (IV), and (V) is attained by summing the partial Equations (VI) and (VII) below, resulting in Equation (VIII) below:

$$1.5CH_4 + 1.5CO_2 \longrightarrow C_3H_6O_3 \quad (VI)$$

$$r(CH_4 + 0.5O_2 \longrightarrow CH_3OH) \quad (VII)$$

wherein the term "r" is the number of mols of methanol per mol of trioxane in the product stream.

One can thus obtain a desired proportion of trioxane in methanol in a mixed product stream ("r") by adjusting the ratio of the components of the feed, e.g. light hydrocarbon, carbon dioxide, and oxygen, to the reaction process or reactor train. As disclosed above, it is desirable to obtain different concentrations of trioxane in methanol due to variations of the solubility of trioxane in methanol at different temperatures. By use of a process of this invention, one can advantageously produce different compositions of methanol and trioxane containing various desired ratios of trioxane to methanol corresponding to needs relating to different transportation temperatures and conditions or for other uses.

For example, Table IV below is a summary for a process utilizing Reaction (I)–(V) to produce different compositions of trioxane and methanol, wherein the light hydrocarbon is methane and the feedstream contains only methane and carbon dioxide, i.e. no inerts or sulfur or other reactive compounds present.

TABLE IV

| | Volume Percent Methane in Feed | Volume % Carbon Dioxide in Feed | Ratio of Volume of Methane to Carbon Dioxide | Product Composition |
|---|---|---|---|---|
| (1.) | 94.7 | 5.3 | 17.9 | 10 wt. percent trioxane in methanol |
| (2.) | 76.7 | 23.3 | 3.29 | 45 wt. percent trioxane in methanol |

The general stoichiometric equation for Reactions (I) and (II) can be expressed as Equation (IX):

$$(1+r)CH_4+CO_2+0.05_2\rightarrow(1+r)CO+(1+2r)H_2 \quad (IX)$$

wherein the term "r" is defined as above.

According to the thermodynamic data above relating to Reactions (I) and (II), Equation (IX) represents an overall exothermic reaction which can be sufficiently heat-producing and can occur without added or external sources of energy, once the reaction is initiated. A reaction system utilizing the overall Equation (IX) is preferably designed to prevent heat losses and is preferably designed to have adequate feed preheating and other heat exchange.

In the above-described process utilizing Reactions (I), (II), (III), (IV), and (V), a small amount of water can be present or added to the process. The water can serve as a reaction moderator by absorbing excess energy from the process and preferably does not, in this variation, enter into the stoichiometry of the reactions.

In another variation of this embodiment, a light hydrocarbon is reacted with carbon dioxide, oxygen and water. The water, which can be present as steam, can react with the light hydrocarbon to form additional synthesis gas comprising primarily carbon monoxide and hydrogen. The carbon monoxide and hydrogen so obtained can then be used to produce methanol and formaldehyde, and in turn trioxane and a composition of methanol and trioxane, as described above. In addition to Reactions (I) through (V) above, the following reaction occurs:

$$CH_{4(gas)}+H_2O_{(gas)}\rightarrow CO_{(gas)}+3H_{2(gas)} \quad (IA)$$

Like Reaction (I), Reaction (IA) above is favored by high temperatures. A calculated $\alpha G_r$ for Reaction (IA), is +5.52 at 800° K. and 1 atmosphere, and is −6.51 at 1000° K. and 1 atmosphere. The near identical free energies and reaction conditions for Reactions (I) and (IA) demonstrate that these reactions can be carried out simultaneously in the same reaction means concurrent with Reaction (II).

The general overall stoichiometric equation for a process represented by Reactions (I), (IA), (II), (III), (IV), and (V) is described by Equation (X) below, again using methane as an exemplary light hydrocarbon:

$$(1.5+0.75r)CH_4+(1.5+0.25r)CO_2+0.5rH_2O\rightarrow C_3H_6O_3+rCH_3OH \quad (X)$$

wherein the term "r" is defined as above. Additional energy to drive this process can be obtained either from an external energy source such as a heat exchange device which can be placed in contact with a process stream feeding the reaction means or can be derived internally by the combination of combustion of a light hydrocarbon such as methane with a free oxygen-containing gas such as air, according to Reaction (XI) below:

$$CH_4+2O_2\rightarrow CO_2+2H_2O \quad (XI)$$

The overall stoichiometrics of a process comprising Reactions (I), (IA), (II), (III), (IV), (V), and (XI) is represented by Equation (XII) below:

$$(0.75r+x+0.5)CH_4+(0.25r-x+0.5)CO_2+(0.5r-2x)H_2O+2xO_2\rightarrow C_3H_6O_3+rCH_3OH \quad (XII)$$

wherein the term "r" is the same as above and the term "x" represents the number of mols of additional light hydrocarbon such as methane added with 2x moles of oxygen to produce thermal energy which can be used to drive the overall reaction.

The amount of oxygen and light hydrocarbon such as methane entering the reactor means or reaction train to provide thermal energy or heat to drive the reaction can be determined by the amount of energy required to provide sufficient conversion of a feed process stream to a synthesis gas comprising carbon monoxide and hydrogen. Generally, the value of "x" can be dependent upon reaction equipment efficiency and heat conversion. The value of "x" (for $O_2$) in Equation (XI) above can be varied to obtain a desired methanol-trioxane ratio in the product, that is, a desired "r".

Table V below is a summary for a process utilizing Reactions (I), (IA), (II), (III), (IV), and (V) to produce different compositions of trioxane and methanol, wherein the light hydrocarbon is methane and the feedstream contains only methane and carbon dioxide.

TABLE V

| | | x | Volume Percent Methane in Feed | Volume Percent Carbon Dioxide in Feed | Ratio of Volume of Methane to Carbon Dioxide |
|---|---|---|---|---|---|
| A. No methane consumed to produce heat to drive reactions. | | | | | |
| (1.) | 10 wt. percent trioxane in methanol | 0 | 72.3 | 27.7 | 2.61 |
| (2.) | 45 wt. percent trioxane in methanol | 0 | 63.3 | 36.7 | 1.72 |
| B. 10% additional methane consumed to produce heat to drive reactions. | | | | | |
| (1.) | 10 wt. percent trioxane in methanol | 2.05 | 74.2 | 25.8 | 2.88 |
| (2.) | 45 wt. percent trioxane in methanol | 1.84 | 71.5 | 28.5 | 2.51 |

Reactions (I), (IA), (II), and (XI) can be represented by the overall equation:

$$(XIII)\ (0.75r + x + 0.5)CH_4 + (0.25r - x + 0.5)CO_2 + (0.5r - 2x)H_2O +$$

TABLE V-continued

| x | Volume Percent Methane in Feed | Volume Percent Carbon Dioxide in Feed | Ratio of Volume of Methane to Carbon Dioxide |
|---|---|---|---|
| $2xO_2 \rightarrow (3 + r)CO + (3 + 2r)H_2$, | | | |

wherein "r" and "x" have the same meaning as above.

Since the number of mols of carbon monoxide and hydrogen formed as a result of the reactions comprising Equation (XIII) can exceed the number of mols of precursors, e.g. light hydrocarbon, carbon dioxide, water, and oxygen, Equation (XIII) is thermodynamically favored by low pressure. Increased reaction pressures can be used to obtain increased contact time with catalysts or the like.

In another variation of this embodiment, after a composition of methanol and trioxane is formed by any of the processes described above, the relative concentration of methanol and trioxane in a given composition can be adjusted to a desired level. By heating a composition of methanol and trioxane to drive off methanol or by adding trioxane or by adding methanol, a given composition can be adjusted to have a predetermined desired concentration of each component.

Feedstreams

For the variations disclosed above, diluents such as inerts or sulfur-containing or other reactive compounds can be present in the feedstream. The light hydrocarbon can thus be present in the feedstream in a concentration in the range of about 30 to about 97.5 volume percent based on total volume of the feedstream, and carbon dioxide can be present in the feedstream in a range of about 2.5 to 40 volume percent, wherein a diluent is present in an amount up to about 50 volume precent of the total volume of the feedstream.

The feedstreams preferably are obtained and used at or near their source of origin such as a natural gas well or a mine. Natural gas (usually after adjustment of the relative composition of hydrocarbons and carbon dioxide) is one of the preferred feedstreams; another feedstream—preferred in conjunction with coal or shale or heavy hydrocarbon operations—is a gas stream obtained by gasification of coal or kerogen (shale bitumens), preferably at the mine site. Dependent upon the composition of the gas, i.e., gasification of coal, kerogen or heavy hydrocarbons, the feedstream will be further processed in one or more of the steps described below. Preferably the gasification of such solid or viscous materials will be carried out to yield a synthesis gas stream (CO and $H_2$) which is then further processed as described below.

The feedstream can be a first process stream comprising a light hydrocarbon, carbon dioxide, and a contaminant. The contaminant can be an inert such as nitrogen or helium or can be a reactive compound such as a sulfur compound like hydrogen sulfide. The separation means can be a conventional separation means like an acid scrubber, a fractionating column, an extractor utilizing a selective solvent, a sorber means using sorption on a solid carrier such as a zeolite molecular sieve, and others and combinations thereof. The first process stream containing a contaminant can be contacted with a removal agent such as an acid, a solvent, a sorbing solid, and the like. The removal agent can remove at least a portion of the contaminant and/or $CO_2$ from the feedstream to form a process stream comprising primarily light hydrocarbon and carbon dioxide and having a reduced content of contaminant. If the contaminant is elemental sulfur or sulfur-containing compound such as a sulfur-heterosubstituted organic compound, then the sulfur removed in the removal means can be recovered by a suitable sulfur recovery technique such as the Claus process, microbial oxidation, and the like.

If the contaminant is an inert such as nitrogen, the contaminant can be optionally removed by low temperature condensation and fractional distillation or membrane permeation separation means. The effluent from the separation means can thus comprise a process stream having a reduced content of contaminant.

Synthesis Process

The feedstream comprising light hydrocarbon and carbon dioxide can be admixed with a desired quantity of a free oxygen-containing gas such as enriched air to form a reaction stream or a second process stream. Preferably, the feedstream comprising light hydrocarbon and carbon dioxide is admixed with a desired quantity of a gaseous stream comprising at least about 70 volume percent oxygen, or more preferably at least about 80 volume percent oxygen, to minimize the amount of inert gas in the system.

The second process stream comprising light hydrocarbon and carbon dioxide can pass to a mixing means. In the mixing means, the ratio of light hydrocarbon to carbon dioxide can be adjusted by adding, from an external source, either carbon dioxide or a light hydrocarbon to achieve the desired ratio. Preferably, oxygen is added to the process in the mixing means. Water can be added to the second process stream in the mixing means in order to have sufficient water present for Reaction (IA) to occur in a later process step. Furthermore, unreacted carbon monoxide or hydrogen or both from a later process step can be recycled and can be added to the mixing means.

The mixing means can be any suitable mixing device such as a gas blender, a static mixer, a venturi mixer, a series of mixing baffles, and other mixing devices.

The effluent from the mixing means can form a third process stream comprising light hydrocarbon, carbon dioxide, oxygen, and alternatively water; or recycled unreacted carbon monoxide and/or hydrogen. The third process stream can contain light hydrocarbon, carbon dioxide, oxygen, and alternatively water, in the stoichiometric proportions required to form a desired methanol-trioxane composition.

The third process stream can be passed to a reforming means. The third process stream can be at a pressure suitable for reforming or reacting the components of the third process stream comprising light hydrocarbon, carbon dioxide, oxygen, and alternatively water to form a synthesis gas comprising carbon monoxide and hydrogen. The reaction pressure can be any suitable value, for examaple in the range of about 200 to 600 pounds per square inch. The third process stream can be pressurized by use of a compression means such as a reciprocal compressor, a rotary turbine, and the like. Since the light hydrocarbon and carbon dioxide can be obtained from a pressurized natural reservoir, the third process stream can be introduced at a pressure suitable for reforming and compression may not be necessary.

The reforming means can be a conventional reforming vessel and can contain a catalyst. The reforming means can contain a bed of catalyst supported on a suitable catalyst support such as a screen, perforated plate, wire mesh or the like. Preferably, the reforming means comprises a series of tubes containing catalyst, wherein the tubes are made of a suitable refractory such as alundum. Catalyst in the reforming tubes can be spaced or grouped into separate portions by a retaining means such as inert catalyst supports or perforated supporting plate means made of refractory material, to avoid intense local heating or catalyst damage which can be caused by the combustion of a portion of the light hydrocarbon with oxygen in proximity with the catalyst.

The third process stream can be heated prior to feeding the steam to the reformer. The third process stream can be passed in contact with a first portion of a heat exchange device such as a shell-tube heat exchanger. The effluent from the reforming means can contain significant thermal energy and can be passed in contact with a second portion of the heat exchange device and can transfer thermal energy from the effluent of the reforming means to the third process stream to preheat the third process stream prior to feeding the third process stream to the reforming means.

The third process stream reaction temperature can be adjusted, either by combustion of a portion of a light hydrocarbon with oxygen or by energy transfer to the stream via the heat exchange device discussed above which is in contact with the reforming means effluent. The third process stream can be adjusted to any suitable reforming reaction temperature, for example a temperature of about 650° to about 1100° C., prior to being reformed or reaching a catalyst in the reformer. Preferably, the third process stream in contact with a catalyst in the reformer is at a temperature in the range of about 750°-900° C.

Although the third process stream can be converted to carbon monoxide and hydrogen in the absence of a catalyst, a catalyst is preferred in the reforming means to achieve conversion to carbon monoxide and hydrogen and less degradation and less formation of byproducts.

In the reforming means, the third process stream is preferably contacted with a suitable catalyst such as a metal oxide like nickel oxide on an alumina, silica, or silica/alumina base. The third process stream can remain in the reforming means or can remain in contact with a catalyst in the reforming means for a sufficient time at the above stated temperatures and pressures conducive to the formation of a fourth process stream comprising a synthesis gas comprising carbon monoxide and hydrogen.

Synthesis Gas Reactions

The fourth process stream comprising carbon monoxide and hydrogen can be passed to a synthesis gas reaction means. In the synthesis gas reaction means, carbon monoxide and hydrogen can be reacted to form a synthesis gas reaction product comprising methanol and formaldehyde. The synthesis gas reaction means can be a single reactor means wherein the carbon monoxide and hydrogen can be contacted with a catalyst under conditions of temperature and pressure conductive to the formation of methanol and formaldehyde in the single reaction means. The pressure in the synthesis gas reaction means can range from about 200 to about 400 pounds per square inch.

Production of Formaldehyde and Methanol

The synthesis gas comprising carbon monoxide and hydrogen can be contacted in the synthesis gas reaction means with catalyst to sequentially or simultaneously form formaldehyde and methanol. The catalyst can consist of catalyst selected from the group consisting of metal oxides, such as copper and zinc oxides or mixtures thereof, and metals such as copper, zinc, selenium and mixtures thereof, and the like on bases such as silica, alumina, silica/alumina or the like. In conversion of the synthesis gas to methanol, the preferred catalyst is copper and zinc oxides on alumina. For conversion of the synthesis gas to formaldehyde, the preferred catalyst contains copper, zinc, and selenium, wherein the amount of selenium does not exceed that of zinc.

Two or more catalysts can be used and they can be admixed or positioned in alternating layers in the synthesis gas reaction means. Preferably two catalysts are used in two layers or series vessels, wherein the first bed comprises a catalyst which has a propensity to methanol synthesis, such as a copper and zinc oxide on alumina, and the second bed comprises a catalyst which has a selectivity to formaldehyde synthesis, such as a copper-zinc-selenium catalyst.

A temperature gradient is preferably maintained across the synthesis gas reaction means since methanol is generally formed at a temperature lower than that at which formaldehyde is formed. The temperature in the synthesis gas reaction means can be any suitable value, and in general will be in the range from about 200° C. to about 750° C. The temperature can range from about 200° C. at the entry portion of the first synthesis reaction bed, wherein methanol can be formed, to about 750° C. at the exit portion, where formaldehyde can be formed. Preferably, the temperature at the entry portion of the first synthesis reaction bed is maintained at a temperature in the range of about 200° to about 400° C. and the second bed is maintained at a temperature of about 500°-750° C. Most preferably, the temperature in the first bed is maintained at a temperature in the range of about 200°-400° C. and in the second bed the temperature is maintained at about 550°-650° C. If the methanol so formed is exposed to too high a temperature for an excessive period of time, a portion of the methanol formed can be decomposed. Preferably, the overall temperature in the first synthesis reaction means is maintained at a gradient from about 350° C. in the first portion of the reaction means to about 550° C. in the second portion of the reaction means, to prevent such decomposition.

In one embodiment two synthesis gas reaction means are used. A first and second portion of the synthesis gas comprising carbon monoxide and hydrogen can be passed to a first synthesis gas reaction means which is operated at pressures and temperatures conducive to the formation of methanol from the first portion of synthesis gas. The first portion of the carbon monoxide and hydrogen are reacted in the first synthesis gas reaction means to form a first synthesis gas reaction product comprising methanol, in the presence of the second portion of the carbon monoxide and hydrogen. The second portion of synthesis gas comprising carbon monoxide and hydrogen is preferably not reacted in the first synthesis gas reaction means. In the first synthesis gas reaction means, the first and second portions of the synthesis gas can pass in contact with a catalyst which has a selectivity to form methanol, such as a zinc and copper oxide catalyst. The temperature in the first synthesis gas reaction means can range from about 200° to about 400° C. The pressure in the first synthesis gas reaction means can range from about 200 to about 400 pounds per square inch.

The effluent of the first synthesis gas reaction means comprising methanol and the second portion of synthesis gas comprising unreacted carbon monoxide and hydrogen can pass in contact with a heat exchange device such as a shell-tube heat exchanger wherein the temperature of the effluent of the first synthesis gas reaction means can be increased to a temperature suitable for conversion to formaldehyde.

The effluent from the first synthesis gas reaction means can be passed to a second synthesis gas reaction means. The second portion of carbon monoxide and hydrogen can be reacted in the second synthesis gas reaction means in the presence or absence of the first synthesis gas reaction product comprising methanol to form a second synthesis gas reaction product comprising formaldehyde. Preferably, a catalyst comprising copper, zinc, and selenium, wherein the amount of selenium does not exceed that of zinc, is used in the second synthesis gas reaction means. The temperature in the second synthesis gas reaction means can range from about 500° to about 750° C. Preferably, the temperature ranges from about 550° to about 650° C. The pressure in the second synthesis gas reaction means can range from about 200 to about 400 pounds per square inch.

In still another embodiment, the synthesis gas comprising carbon monoxide and hydrogen can be reacted to form a synthesis gas reaction product comprising methanol. The synthesis gas can be passed to a synthesis gas reaction means wherein the carbon monoxide and hydrogen can be substantially completely converted to methanol, preferably in the presence of a catalyst and at temperatures and pressures outlined above for other conversions of synthesis gas to methanol. Then at least a portion of the methanol can be converted to formaldehyde. That is, the methanol which is the product of the synthesis gas can be split into two streams. One methanol stream can be reacted to form formaldehyde, such as via processes for the oxidative reaction of methanol to formaldehyde and by other methods of formaldehyde formation from methanol known in the art.

The above reactions of synthesis gas to form methanol and formaldehyde are endothermic, and additional heat can be added to maintain the reactor temperature at a desired level. Heat can be added via an external energy addition by passing the streams in contact with heat exchange devices. Heat can be added by heat exchange contact with energy-enriched process streams, such as the reforming means effluent. The products of the synthesis gas reaction means thus comprise methanol and formaldehyde.

Trimerization of Formaldehyde to Trioxane

The formaldehyde can be trimerized to trioxane in the absence or in the presence of methanol.

In the trimerization of formaldehyde to trioxane, use of an acid catalyst is preferred. The catalyst can be homogeneous or heterogeneous in respect to the formaldehyde stream. The catalyst can be an organic or inorganic acid, and can be used separately or in combination.

Homogeneous catalysts include sulfuric acid, low molecular weight alkyl and aromatic sulfonic acids, and the phosphoric acids. Homogeneous catalysts can be added to a formaldehyde trimerization means with turbulent flow. The formaldehyde-trimerization means can be a plug-flow or back-mixed reactor or the like.

Heterogeneous catalysts can include minerals containing acid sites and ion exchange resins containing sulfonic acid groups. Heterogeneous catalysts can be positioned in a formaldehyde-trimerization means comprising a fixed catalyst bed through which a liquid stream of formaldehyde can flow.

The formaldehyde can be trimerized to trioxane at a temperature ranging from about 0° C. to about 200° C. Preferably, the temperature in the formaldehyde trimerization means ranges from about 35° C. to about 65° C. Formaldehyde can be held within the formaldehyde trimerization means for a period of time sufficient to achieve a desired degree of completion. The pressure of the formaldehyde trimerization means can be maintained in the range of from about 14.7 to about 1470 psia. Preferably the pressure is in the range of from about 200 to about 400 psia, and high enough to keep the formaldehyde in solution in the methanol.

While for the purposes of minimizing construction cost or simplifying operation it may be appropriate to operate the formaldehyde trimerization means at the same pressure as the methanol-formaldehyde forming means, for maximum efficiency a pressure reducer can be included to permit trimerization of the formaldehyde at a lower pressure, e.g., in the range of from about 200 to about 400 psia.

A small amount of water such as less than about 20 weight percent of the contents of the formaldehyde trimerization means, less the weight of the catalyst, can be present in the formaldehyde trimerization means and can serve to assist or promote the trimerization of formaldehyde to trioxane.

The effluent from the formaldehyde trimerization means can comprise trioxane along with any unreacted formaldehyde, if the formaldehyde is trimerized in the absence of methanol. The effluent can comprise trioxane, methanol, water and any unreacted formaldehyde if the formaldehyde was trimerized in the presence of methanol and/or water.

If a heterogeneous catalyst contained in a fixed catalyst bed is used in the formaldehyde trimerization means, the effluent from the formaldehyde trimerization reaction means can pass to a pressure control means wherein the reaction effluent can be brought to atmospheric pressure. Preferably the temperature of the formaldehyde trimerization reaction effluent is sufficiently high, that is, above a temperature in the range of from about 75° C. to about 80° C., to permit a flashing of a portion of the reaction effluent to remove unreacted formaldehyde. The unreacted formaldehyde that is flashed can be directed back to the formaldehyde trimerization means.

If a homogeneous catalyst is used in the formaldehyde trimerization means, the effluent of the formaldehyde trimerization reactor can be neutralized or can have the catalyst removed. Neutralization or removal of the catalyst is preferred to prevent corrosion. The catalyst can be removed by distillation. The effluent from the formaldehyde trimerization means can be directed to a separation or a distillation means such as a fractionating column. In the fractionating column, the effluent can be separated into methanol and trioxane fractions, as desired. The effluent can also be separated into a second fraction comprising the catalyst which can be recycled for use in the formaldehyde trimerization reaction means.

A homogeneous catalyst can be neutralized by the addition of a basic compound such as lye, either in the oxide or hydroxide form. Solids or salts so formed by the neutralization can be separated by filtration or settling from the trioxane. Mineral ores or coal can also be used to neutralize the catalyst, when such coal or mineral ores contain sufficient basic compounds to achieve the neutralization. Solids or salts formed from neutralization need not be separated from the trioxane so formed, but can be separated from the trioxanes if desired.

Sources of Feedstock Gases

Gases containing a light hydrocarbon and carbon dioxide suitable for use in the above described processes are not limited to natural gas obtained from subterranean natural deposits. Synthetic gases from coals, oil shale, crude and refined petroleum, etc. are also sources of gases containing a light hydrocarbon and carbon dioxide. For example, vent or offgases from the in situ gasification or combustion of coal or oil shale or from the heating of oil shale or coal in a retort can be suitable for use in the above described processes, or can be made suitable for use in the processes by the addition of or combination with other gas streams.

Also, gases containing a light hydrocarbon and carbon dioxide that are stripped from coal fields, oil shale deposits, tar sands and the like prior to mining are suitable as sources of carbon dioxide and methane for use with the above described processes.

Furthermore, a synthesis gas suitable for use in the above described processes can be obtained by the gasification of coal and introduced as at least a portion of the fourth process stream, comprising carbon monoxide and hydrogen. A synthesis gas can be obtained by treating coal with steam and/or industrial oxygen as noted by Keller in U.S. Pat. No. 3,968,999 (1976). Such as synthesis gas can be converted to methanol, formaldehyde and trioxane, as described above, with the objective of providing methanol-trioxane compositions and slurries thereof with solid fuels such as coal.

Fermentation

Furthermore, a gas comprising a light hydrocarbon and carbon dioxide can be produced by anaerobic microbial and/or enzymatic fermentation of cellulosic and/or hemicellulosic material. Cellulosic and hemicellulosic material (biomass) which can be substrates for fermentation can include liquid waste such as sewage, solid waste such as garbage, agricultural wastes such as sugarcone bagasse, corn stover (cobs, stalks, etc.), wheat chaff and straw, and forestry wastes such as sawdust.

The anaerobic digestion of biomass, i.e. cellulosic and hemicellulosic material, usually proceeds in two steps, each carried out by different families of anaerobic organisms. Initially a group of acidogenic bacteria, e.g., *clostridium thermocellum*, degrade the biomass to produce organic acids, $CO_2$ and $H_2$. These products are used as substrates by a second group of bacteria called methanogens to produce methane and $CO_2$. See, e.g., Datta, "Acidogenic Fermentation of Corn Stover", Biotechnology and Engineering, Vol. XXIII, pp. 61–77 (John Wiley & Sons, 1981). Various bacteria, molds, yeasts and fungi can be used, as well as enzymes in homogeneous and immobilized condition.

Preferably, various algae can form the substrate for fermentation which is used to produce a gas comprising a light hydrocarbon and carbon dioxide. The macroforms of the pheoplyceae including marine algae such as fucus, laminaria and sargassum can be used. Also, algae such as chlorella, ankistrodesmus, scenedesmus, euglene, chlamgclomonas, oscillatoria, micratinium, galenkinia and other algae suitable for the growth of fermentation of an aqueous or other suitable environment are within the scope of this invention. The algae source of light hydrocarbon and carbon dioxide can be grown or cultivated in a suitable aqueous solution, such as that found in shoreside ponds or in controlled, cultivated offshore areas.

The algae sources of a light hydrocarbon or carbon dioxide can be harvested or recovered by a recovery means such as filtration, microstraining, clarification, centrifugation, sedimentation, air flotation, flocculation, or combinations thereof, or other recovery processes. For instance, the algae can be recovered by means of mechanical devices such as screens, mechanical scoops, vacuums, and the like. Preferably, the algae recovery is by combined chemical and mechanical recovery such as coagulation by a coagulant such as alum, gums, or other known coagulants, followed by filtration, sedimentation, air flotation, and the like. The algae so recovered need not be dried for subsequent processing by fermentation to form a light hydrocarbon and carbon dioxide. The algae recovered can, however, be dried prior to fermentation.

The recovered algae or other biomass can be reduced to a suitable particle size by suitable size reduction operations such as grinding, cutting, shredding, chopping, and the like, whenever necessary, such as may be the case following recovery by chemical coagulation. Particles with a maximum dimension in the range of, for example, from about ½ inch to about 1 inch are suitable for use in industrial fermenters, with the larger particles requiring longer residence time. Particle sizes in the range of about ½ to about ¾ inches are preferred for rapid digestion or fermentation to yield a light hydrocarbon and carbon dioxide.

The algae or particles of algae or other biomass can be admixed with a fluid such as water or alcohols to form a pulp. Similarly, agricultural wastes are usually shredded or pulped. Fermentation initiators or aids such as enzymes, yeast or bacteria can be added to the pulp. The pulp of recovered algae can be directed or fed to a fermentation means or digestion means. The means used for fermentation can be an anerobic pond which is covered so that the fermentation product gas comprising a light hydrocarbon and carbon dioxide can be collected therefrom. Preferably, the fermentation means is a well mixed and heated stirred tank reactor having inlet and exit conduits.

The fermentation means should be operated under conditions of pressure and temperature conducive to the fermentation of algae or other biomass to form a light hydrocarbon and carbon dioxide. The fermentation means can be operated at a pressure in the range of about 0.1 to about 1 atmospheres and a temperature in the range of about 15° to 70° C., preferably about 25° to about 40° C. Such fermentation conditions are generally known in the art. Preferably, the fermentation means is operated at about atmospheric pressure and at a temperature in excess of 35° C.

TRANSPORTATION OF GASES AS METHANOL-TRIOXANE COMPOSITION

In accordance with another embodiment of this invention, a gas containing a light hydrocarbon is transformed into an energy-rich liquid suitable for transport by reacting the light hydrocarbon with carbon dioxide to form a composition of methanol and trioxane. The carbon dioxide can be a component of the gas which contains a light hydrocarbon, e.g. carbon dioxide in a carbon dioxide rich natural gas. Also, the carbon dioxide can be added to the gas and admixed with the light hydrocarbon. Sources of carbon dioxide are flue gases, reactor offgases, carbon dioxide rich reservoirs, and others. The concentration of light hydrocarbon and carbon dioxide can be adjusted to a desired ratio as described above, so that, e.g. the desired proportion of trioxane in methanol in a mixed product stream is obtained. This ratio can be a stoichiometric ratio, but need not be, as excess light hydrocarbon can be used as a fuel to drive the conversion of carbon dioxide and light hydrocarbon to a synthesis gas comprising carbon monoxide and hydrogen. The carbon dioxide and light hydrocarbon can then be converted to a composition of methanol and trioxane via the steps of the processes outlined above, or via other suitable processes. The composition of methanol and trioxane thus formed can then be transported to a desired location. The transportation can be by conventional pipeline or tanker, including tank truck and rail car, or other known methods.

In one variation of this embodiment, after the composition of methanol and trioxane has been transported to its final destination, the trioxane is separated from the methanol by distilling off the methanol. The trioxane so removed can then be converted into methane and carbon dioxide. The method can be used for any suitable use, i.e. reagent or fuel end uses as a natural gas. The carbon dioxide so derived can be particularly useful, e.g., in the tertiary recovery of subterranean oil deposits. After primary and secondary operations have depleted all oil removable by those operations, tertiary recovery utilizing the carbon dioxide so formed can be used to obtain still more oil as the carbon dioxide produced from a composition of trioxane and methanol can be injected into geological formations to force out more oil.

CRACKING OF METHANOL-TRIOXANE COMPOSITION

In another variation of this embodiment, after the composition of methanol and trioxane has been transported to its final destination, the composition is cracked into a synthesis gas comprising hydrogen and carbon monoxide. Also, the composition can be separated into methanol and trioxane and each separately cracked to form a synthesis gas. Pyrolysis of the composition, or of the methanol and trioxane separately, in the presence of suitable catalyst can produce hydrogen along with other compounds, especially carbon monoxide. The hydrogen so produced can be used in various hydrogenation reactions, e.g. hydrogen treating of distillates. Also the hydrogen can be used as a reactant for the production of ammonia, methanol, urea, hydrogen cyanide, and other compounds. Also, a synthesis gas produced containing hydrogen and carbon monoxide can be reacted with an olefin in the presence of a suitable catalyst, such as cobalt, to produce aldehydes. The hydrogen so formed can further be used to hydrogenate aldehydes to give alcohols.

SOLID AND VISCOUS FUEL SLURRIES

In still another embodiment of this invention, a solid fuel is slurried with a composition of methanol and trioxane. The slurry so formed can then be used as a medium for transporting the solid fuel and the composition of methanol and trioxane to a desired destination. If the composition of methanol and trioxane has been formed from a gas containing a light hydrocarbon such as methane, then the composition also acts as a medium for the transportation of the light hydrocarbon. The transportation of a slurry comprising methanol, trioxane, and a solid fuel can be by conventional mode such as pipeline, tanker, tank trunk, railcar, or other modes of transporting such materials. Many different solid fuels can be slurried with a composition of methanol and trioxane. Among these are coals, wood chips or particles, plant matter such as rice hulls or peat moss and briquets or pellets of other combustible matter. The term coals is used herein to include coal of all ranks, from anthracite to sub-bituminous coals and lignites. The term "solid fuel" as used herein includes materials which are amorphous, highly viscous, non-flowable or non-pumpable at ambient temperature, such as shale oils, kerogen, tar sand extracts, asphaltic crudes and residual fuels, because such materials have some solid fuel characteristics.

In one variation of this embodiment, a composition of methanol and trioxane is prepared according to the above-disclosed or other suitable processes. A solid fuel is shaped into a desired particle size or form by grinding, cutting, crushing, precipitating, extruding, or any known method of preparing such fuel into a desired particle size. A mixture or slurry of the composition of methanol and trioxane and the solid fuel can be then formed by combining the composition and the solid fuel. This combination can be made in a suitable mixer. The mixing by the mixer can be either batch or continuous. With viscous or amorphous solid fuels, suitable techniques can be used to reduce the material to a suitable particle size. When combined with the methanol-trioxane slurry agent, such fuels may partially dissolve, or form suspensions or dispersions as emulsions. The mixture resulting when the fuel and slurry agent are combined by a suitable mining process is also to be considered a slurry for the purposes of this disclosure. The resulting slurry can be then transported to a desired location by the above described modes.

In still another variation of this embodiment, at the final transportation destination, a solid fuel and a slurry agent which comprises a composition of methanol and trioxane can be consumed or burned together directly as a fuel. The composition of methanol and trioxane need not be separated from the solid fuel as the entire mixture can be consumed as a fuel.

After suitable transportation, a solid fuel can be separated from the transportation slurry agent comprising a composition of methanol and trioxane. The separation can be performed by heating the combined mixture or slurry in such manner that either the methanol alone or both the methanol and trioxane are driven or distilled off, leaving the solid fuel. This procedure can be used when it is desired to consume the solid fuel alone as a fuel and to use the composition of methanol and trioxane separately. The mixture of solid fuel and a composition of methanol and trioxane can be heated to a temperature in excess of the boiling point of methanol (67° C. at atmospheric pressure) to drive off the methanol alone, leaving the solid fuel and the trioxane to be burned together as a fuel or to be put to another use. The mixture can also be heated to a higher temperature such that both the methanol and trioxane are removed from the mixture. The methanol and trioxane so obtained can be further separated by distilling the composition of methanol and trioxane to obtain methanol alone.

The use of a composition of methanol and trioxane as a slurry agent for a solid fuel has tremendous advantages over the use of water as a slurry agent for a solid fuel. For example, due to the polar organic character of a trioxane-methanol slurry agent, it tends to produce solid fuel slurries which are stabler and smoother, thus easier to pump, than when water is used. Such slurries can be stabilized further by adding water and/or a detergent, preferably a synthetic detergent such as a member of the family of polyethoxylated phenols. The trioxane-methanol composition can also be used to dissolve and/or disperse hydrocarbon mixtures such as an asphaltic crude, residual fuel, or a solid fuel to render it pumpable. Such materials often are too viscous to be pumped absent a dispersal agent. Water is frequently a scarce commodity. Also, water is often not available in sufficient quantities to allow industrial use as a slurry agent for solid fuels when domestic, agricultural or other uses have priority. Furthermore, if water is combined with a solid fuel such as coal, the water may have to be separated from the solid fuel before the combustion of the fuel. The costs of this are often prohibitive.

A composition of methanol and trioxane can be an improved slurry agent for solid fuels, compared with fuel oils. Fuel oils which are used as slurry agents for solid fuels also often are contaminated with sulfur, nitrogen and heavy metals such as nickel and vanadium. The composition of methanol and trioxane is generally devoid of these contaminants. Thus, burning a solid fuel admixed with a contaminated fuel oil as a slurry agent can cause increased pollution. On the other hand, burning of a solid fuel in combination with a composition of methanol and trioxane as a slurry agent for the solid fuel will result in less pollution. Slurries of trioxane, methanol and fuels can be prepared which are suitable fuels for combustions in furnaces, boilers for steam plants and internal combustion engines, including diesel engines.

The invention is further described with reference to the drawings and the discussion below, but is not limited thereto.

DETAILED DESCRIPTION OF THE DRAWINGS

Figure 2:
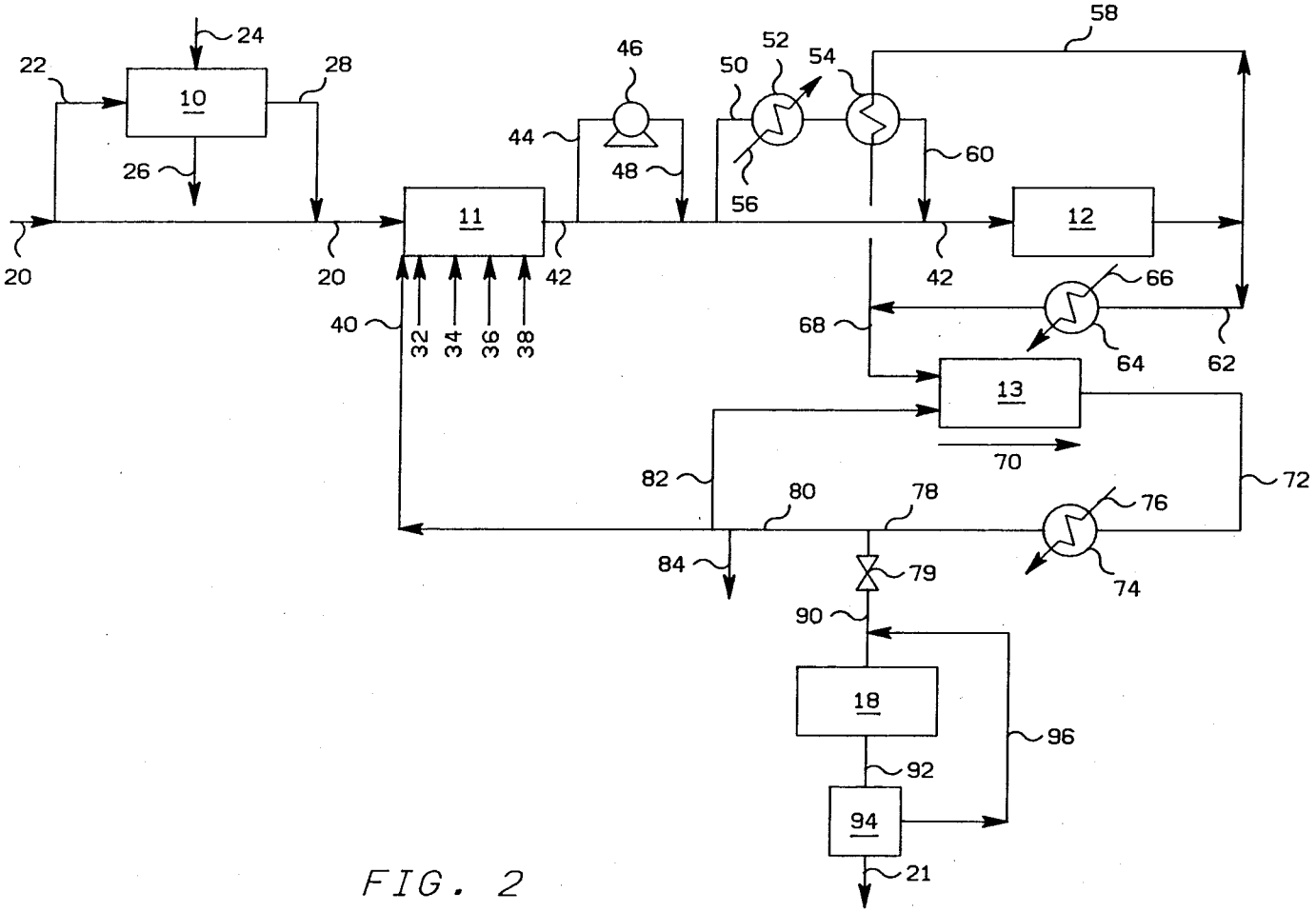
FIGS. 2, 3, and 4 are diagrammatical arrangements showing methods to produce a composition of methanol and trioxane.

FIG. 2 is a diagrammatical arrangement illustrating a process to produce a composition of methanol and trioxane. A process stream comprising a light hydrocarbon and carbon dioxide in conduit 20 is passed to a mixing means 11 wherein other reactants such as oxygen are admixed with the carbon dioxide and light hydrocarbon. Reactants are then passed to a reforming means 12 wherein a synthesis gas comprising carbon monoxide and hydrogen is formed. The carbon monoxide and hydrogen are passed to synthesis gas reaction means 13 in which formaldehyde and methanol are produced. Said formaldehyde and methanol are then passed to formaldehyde trimerization means 18, wherein formaldehyde is trimerized to trioxane to form a methanol-trioxane composition. Optionally, pressure-reduction means 79 can be used to maintain formaldehyde trimerization means 18 at a pressure lower than that in synthesis gas reaction means 13.

The process stream comprising a contaminated light hydrocarbon and carbon dioxide in conduit 20 can optionally pass via conduit 22 to a separation means 10. Separation means 10 can be a scrubber, an extractor, a sorption device, a membrane permeation device, a fractionating column or the like, wherein contaminants can be removed from the process stream. A removal agent in conduit 24 will pass to the separation means 10 and pass in contact with the process stream comprising a light hydrocarbon, carbon dioxide, and at least one contaminant. The effluent from the separation means in conduit 26 then contains the removal agent and a contaminant. The second effluent from the separation means in conduit 28 is the process stream comprising light hydrocarbon and carbon dioxide having a reduced content of contaminant, and passes via conduit 20 to mixing means 11.

In mixing means 11, the process stream comprising carbon dioxide and light hydrocarbon is admixed with at least one additional reactant. The mixing means 11 can be a static mixer, a stirred vessel, a venturi mixer, or the like. The ratio of carbon dioxide to light hydrocarbon can be adjusted in the mixing means by the addition of hydrocarbon via conduit 32 or the addition of carbon dioxide via conduit 34. Oxygen can be added to mixing means 11 via conduit 36 as substantially pure oxygen or as a gas containing free oxygen such as air. Water optionally can be added to mixing means 11 via conduit 38 to provide water needed to carry out Reaction (IA) as discussed above. Preferably, when water is added it is added in the form of steam. A process stream comprising unreacted hydrogen or carbon monoxide or both can be added to mixing means 11 via conduit 40 as will be discussed below. The effluent of the mixing means in conduit 42 can thus comprise light hydrocarbon, carbon dioxide, oxygen, and alternatively, water, carbon monoxide, hydrogen or combinations thereof.

If the effluent of the mixing means in conduit 42 is at a suitable pressure for reforming, then the mixing means effluent will pass directly via conduit 42 to reforming means 12. If the pressure of the mixing means effluent is not suitable for reforming, then the effluent in conduit 42 is passed via conduit 44 in contact with a compressor means 46 such as a reciprocal compressor or rotating turbine. Mixing means effluent in conduit 48 will thus have a pressure significantly greater than mixing means effluent in conduit 44.

If mixing means effluent in conduit 42 has a temperature that is too low for reforming, then the mixing means effluent will pass via conduits 42 and 50 in contact with heat exchange device 52 or 54. Heat exchange devices 52 and 54 can be used alternatively or conjunctively. An energy-enriched heat transfer medium in conduit 56 passes in contact with heat exchange device 52 and transfers energy to the mixing means effluent in conduit 50. A hot reforming means effluent in conduit 58 passes in contact with heat exchange device 54. Mixing means effluent in conduit 50 also passes in contact with heat exchange device 54. Heat can thus be transferred from a hot reforming effluent in conduit 58 to the mixing means effluent. Mixing means effluent in conduit 60 will thus have a temperature which is greater than mixing means effluent in conduit 50.

Mixing means effluent comprising light hydrocarbon, carbon dioxide, oxygen, and alternatively water, carbon monoxide, hydrogen, or combinations thereof, thus passes to reforming means 12 at conditions of pressure and temperature conducive to the formation of a synthesis gas comprising carbon monoxide and hydrogen. Preferably, the pressure in reforming means 12 is maintained in a range of from about 200 to about 600 pounds per square inch. Temperature in the reforming means is maintained in the range of from about 650° to about 1100° C. Temperatures in the range of from about 750° to about 900° C. are preferred. Formation of synthesis gas can occur in the absence of a catalyst, but preferably a catalyst is used in reforming means 12. Most preferably, a nickel oxide catalyst on an alumina base is used in the reforming means.

The effluent from reforming means 12 is passed via conduits 62 and 58 to synthesis gas reaction means 13. Preferably, the effluent from reforming means 12, comprising carbon monoxide and hydrogen, passes via conduit 58 in contact with heat exchange device 54. As mentioned above, a heat exchange device can be used to transfer energy from the hot reforming means effluent in conduit 58 to the effluent from the mixing means 11 in conduit 50. Preferably, sufficient energy is transferred from the reforming means effluent in conduit 58 to reduce the temperature of the reforming means effluent to a temperature in the range of from about 200° to about 400° C.

The reforming means effluent in conduit 62 passes in contact with heat exchange device 64. The relatively cool heat transfer medium from conduit 66 can pass in contact with heat exchange device 64 to reduce the temperature of the reforming means effluent in conduit 62 to a temperature suitable for feeding to the synthesis gas reaction means 13. Preferably, temperature in the reforming means effluent is reduced to a temperature in the range of from about 200° to about 400° C.

The reaction taking place in reforming means 12 will generally lead to a product stream in conduits 58 or 62 having a volume greater than that of the feedstream in conduit 42. The reforming means effluent in conduits 58 or 62 can be allowed to expand in volume to prevent the development of back pressure in reforming means 12.

The reforming means effluent in conduit 68, comprising carbon monoxide and hydrogen, is directed to synthesis gas reaction means 13. The hydrogen and carbon monoxide components of the synthesis gas in conduit 68 can be converted to both methanol and formaldehyde in a single synthesis gas reaction means 13, as the reaction of carbon monoxide and hydrogen to methanol and the reaction of carbon monoxide and hydrogen to formaldehyde can be carried out in a single reaction means. Either a single dual purpose catalyst or two catalysts arranged in consecutive beds can be used.

Preferably, two catalysts arranged in consecutive beds are used and a temperature gradient is maintained across synthesis gas reaction means 13. Most preferably a positive temperature gradient in the direction of arrow 70 is maintained across synthesis gas reaction means 13, with a temperature at the inlet portion of reaction means 13 lower than the temperature at the outlet portion of reaction means 13, since methanol formation is favored at a temperature lower than that for formaldehyde. The temperature at first contact with a catalyst in the synthesis gas reaction means 13 is preferably maintained at a temperature in the range of from about 200° to about 400° C. The temperature of the reaction mixture in the synthesis gas reaction means 13 near the exit portion of the reactor is preferably maintained in the range of from about 500° to about 750° C., with a temperature in the range of about 550°-650° C. most preferred.

The catalyst preferred for the methanol phase of the synthesis gas reaction is a copper and zinc oxide catalyst on an alumina base. For the formaldehyde phase of the synthesis, a copper-zinc-selenium catalyst, wherein the amount of selenium does not exceed that of zinc, is preferred. The two catalysts can be admixed and can be positioned in alternating layers. Preferably, two catalyst layers are used, wherein a methanol synthesis catalyst is used at the entry portion of the reactor and a formaldehyde synthesis catalyst is used toward the exit end of reactor 13.

An alternative to the use of a temperature gradient reactor as described above is the use of a single temperature reactor. In this alternative, a single dual purpose catalyst or a mixture of a methanol synthesis catalyst and a formaldehyde synthesis catalyst such as described above can be used. Such a single temperature synthesis gas reaction means 13 can be maintained at a temperature in the range from about 350° to about 550° C.

The combined reactions of carbon monoxide and hydrogen to methanol and to formaldehyde are endothermic, thus additional heat is preferably provided to maintain the temperature of synthesis gas reaction means 13 by heat transfer from energy enriched process streams such as the reformer effluent or by heat transfer from other energy sources.

The effluent from the synthesis gas reaction means in conduit 72, comprising primarily methanol, formaldehyde and unreacted carbon monoxide or hydrogen, passes in contact with heat exchange device 74. A relatively cool heat transfer medium in conduit 76 is passed in contact with heat transfer device 74 to form condensed methanol and formaldehyde in conduit 78. Heat removed from the synthesis gas reaction effluent conduit 72 can optionally be used to contribute to the heating of the mixing means effluent in conduit 42 (not shown), or can be used to provide a portion of the heat required to maintain the temperature of synthesis gas reaction means 13 (not shown).

Any unreacted carbon monoxide or hydrogen in conduit 78 can be separated from the condensate and gases by separation means (not shown) and passed via conduit 80 and 82 for recycle to synthesis gas reaction means 13. Alternatively, unreacted carbon monoxide or hydrogen can be passed via conduits 80 and 40 to mixing means 11 for recycle through the reforming and synthesis gas reaction means. Unreacted hydrogen or carbon monoxide can also be vented via conduits 80 and 84, along with any accumulated inerts or other unreacted compounds.

Since higher temperatures in synthesis gas reaction means 13 favor the formation of formaldehyde over methanol, an overall reaction system having a recycle stream comprising hydrogen or carbon monoxide will tend to maintain a desired ratio of formaldehyde (and ultimately trioxane) to methanol and the overall reaction system can self-adjust. If the temperature of synthesis gas reaction means 13 is below that which provides an optimum balance between methanol and formaldehyde formation, the formation of methanol will be favored at the lower temperatures. Thus, there will be a consumption of hydrogen out of proportion to other components of the synthesis gas. Concurrently, the rate of formaldehyde formation will be relatively slow and there will be a low consumption of carbon monoxide.

The ratio of carbon monoxide to other synthesis gas components will increase. On recycle of unreacted hydrogen or carbon monoxide via conduits 80, 82, or 40, the recycled stream reaching synthesis gas reaction means 13 will have a relatively low hydrogen to carbon monoxide ratio. Thus, via the principle of mass action, the formation of methanol will be slowed and the formation of formaldehyde will be enhanced.

On the other hand, if the temperature in synthesis gas reaction means 13 is relatively high, the concentration of methanol in the synthesis gas reaction means effluent in conduit 72 will be relatively low and the concentration of formaldehyde will be relative high. Concurrently, the concentration of hydrogen relative to carbon monoxide in the synthesis gas reaction means effluent in conduit 72, which is recycled via conduits 80, 82 or 84, will become progressively richer in hydrogen and leaner in carbon monoxide. Under these conditions, synthesis of methanol will be favored while synthesis of formaldehyde will be inhibited.

The above-described self adjustment process will occur if the ratio of components fed to mixing means 11 or via recycle in conduits 80 and 82 or 40 are maintained in the proportions specified by Equation (IX) above, and none of the components are vented via conduit 84. If the effluent from the synthesis gas reaction means in conduit 78 comprises unreacted light hydrocarbon, recycle to mixing means 11 via conduits 80 and 40 is preferred. If the synthesis gas reaction means effluent in conduit 78 comprises a relatively high amount of inerts such as helium or nitrogen, these can be vented via conduit 84.

Formaldehyde and methanol in conduit 78 are directed via optional pressure control means 79 and cionduit 90 to a formaldehyde trimerization means 18. Formaldehyde can be trimerized to trioxane in the presence of methanol in formaldehyde trimerization means 18. The acid catalyst and temperatures and pressures conductive to the trimerization of formaldehyde to trioxane as described above can be used to produce a composition of trioxane in methanol, which passes into conduit 92. The trioxane-methanol effluent in conduit 92 is directed to pressure control means 94, which can be a pressure control valve, a surge tank having an orifice of a desired or variable opening, or the like. Unreacted formaldehyde can optionally be flashed and passed via conduits 96 and 90 for recycle to formaldehyde trimerization means 18. The resulting composition of methanol and trioxane in conduit 21 can be recovered as a product, at atmospheric pressure if desired.

Figure 3:
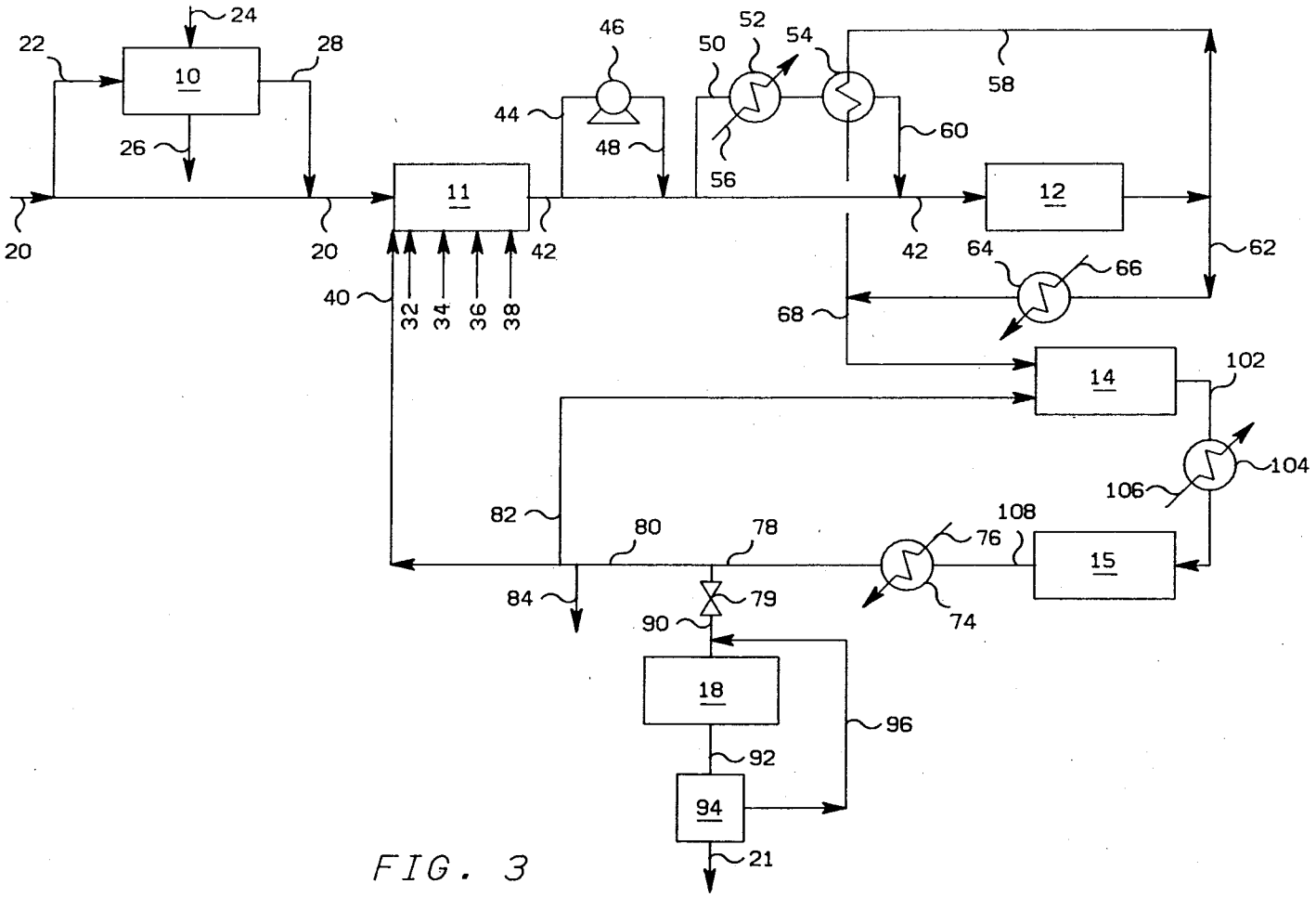

FIG. 3 is a diagrammatical arrangement of another process to produce a composition of trioxane and methanol. In the process shown in FIG. 3, the synthesis gas reactions to form formaldehyde and methanol are carried out in two separate reactors, rather than in a single reactor as in FIG. 2. A synthesis gas in conduit 68, comprising carbon monoxide and hydrogen, is prepared according to the process described relating to FIG. 2 above.

The synthesis gas in conduit 68 is first directed to a first or a methanol synthesis gas reaction means 14. Temperature in this reaction means 14 should be in the range of from about 200° to about 400° C. The effluent from first synthesis gas reaction means 14 in conduit 102 comprises substantially methanol and unreacted carbon monoxide and/or hydrogen. The effluent in conduit 102 passes in contact with heat exchange device 104. A relatively hot heat transfer medium in conduit 106 also can pass in contact with heat exchange device 104. The temperature of the effluent from first synthesis gas reaction means 14 is thus preferably raised prior to feeding the effluent as a process stream to a second synthesis gas reaction means 15.

The temperature in the second synthesis gas reaction means 15 should be in the range of from about 500° to about 750° C. Preferably, the temperature is maintained in the range of from about 600° to about 700° C. In second synthesis gas reaction means 15, substantially all the unreacted carbon monoxide and hydrogen in the effluent from first synthesis gas reaction means 14 is converted to formaldehyde. The pressure in the first and second synthesis gas reaction means should be in the range of from about 200 to about 600 pounds per square inch.

The effluent from second synthesis gas reaction means 15 in conduit 108, comprising substantially methanol and formaldehyde, passes in contact with heat exchange device 74 for condensation. Any unreacted carbon monoxide or hydrogen in the effluent from second synthesis gas reaction means 15 in conduit 108 can be separated and recycled via conduits 80, 82 and 40, or vented via conduit 84, as described relating to FIG. 2. The condensed formaldehyde and methanol in conduit 90 can be used to produce a composition of trioxane in ethanol in conduit 21, as described above in FIG. 2. Optional pressure reduction means 79 can be used to maintain formaldehyde trimerization means 18 at a pressure within the optimum range for the trimerization of formaldehyde.

Figure 4:
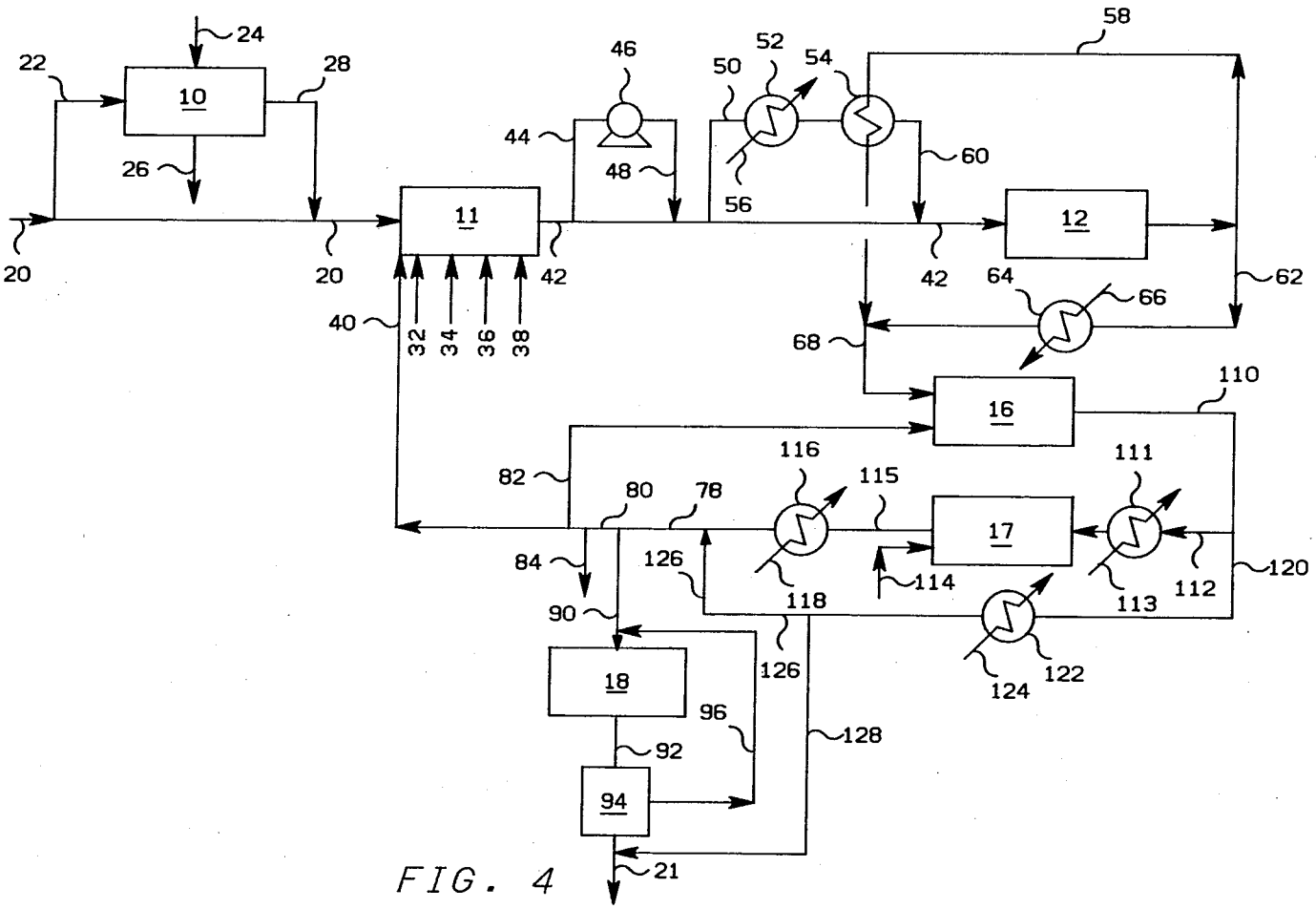

FIG. 4 is a diagrammatical arrangement of still another process to produce a composition of trioxane and methanol. A synthesis gas in conduit 68, comprising carbon monoxide and hydrogen, is formed in a manner described in FIG. 2 above. The synthesis gas in conduit 68 is passed to a first synthesis gas reaction means 16 wherein essentially all of the carbon monoxide and hydrogen components of the synthesis gas reaction means 16 should be in the range of from about 200° to about 400° C. and the pressure should be in the range of from about 200 to about 600 pounds per square inch. A preferred catalyst consisting of copper and zinc oxide on an alumina base can be used. The effluent from first synthesis gas reaction means 16 in conduit 110 preferably comprises substantially methanol.

A portion of the methanol in conduit 110 is preferably directed via conduit 112 in contact with heat transfer 111 to a formaldehyde synthesis reactor 17. A relatively hot heat transfer medium can pass via conduit 113, also in contact with heat transfer device 111, and can transfer energy to the reaction effluent in conduit 112 prior to the feeding of said effluent to formaldehyde synthesis means 17. The temperature of the process stream in conduit 112 is preferably raised to a temperature in the range of from about 600° to about 700° C.

In the second or formaldehyde synthesis reactor 17, the methanol is converted to formaldehyde at a temperature in the range of from about 500° to about 700° C. and at a pressure of from about 200 to about 600 psi. Preferably a copper-zinc-selenium catalyst is used, wherein the amount of selenium does not exceed that of zinc. Other reactants such as oxygen can optionally be added to formaldehyde synthesis reactor 17 via conduit 114. The effluent from formaldehyde synthesis reactor 17 passes via conduit 115 in contact with heat exchange device 116. A heat transfer medium having a relatively high temperature passes via conduit 118, also in contact with heat transfer device 116, to reduce the temperature of the effluent from the formaldehyde synthesis reactor in conduit 115. Any uncondensed and reacted carbon monoxide and hydrogen can pass via conduits 115, 78, 80, 82 and 40 for recycle, or can be vented via conduit 84. As described for FIGS. 2 and 3, separation means can be included for separation of these gases from the condensate.

Condensed formaldehyde in conduit 78 passes via conduit 90 to formaldehyde trimerization means 18, wherein trioxane is formed and passes via conduit 91 to pressure control device 94 as above in FIG. 2. Optional pressure reduction means 79 can be used to maintain formaldehyde trimerization means 18 at a pressure within the optimum range for the trimerization of formaldehyde.

The effluent from first synthesis gas reaction means 16 wherein methanol is produced passes via conduits 110 and 120 in contact with heat exchange device 122. A relatively cold heat transfer medium can pass via conduit 124 in contact with heat transfer means 122. Condensed methanol then passes via conduit 126 and can be admixed with formaldehyde in conduit 78. The formaldehyde and methanol mixture thus passes via conduit 90 to formaldehyde trimerization means 18 where the formaldehyde is trimerized in the presence of methanol.

If formaldehyde has been trimerized in the absence of methanol to form trioxane in reactor 18, condensed methanol can be passed via conduit 128 and be admixed with the trioxane so formed to form a composition of trioxane and methanol in conduit 21.

The relatively cooled heat transfer medium conduits 118 and 124 can be used to provide a portion of the energy input to the reforming means 12, first synthesis gas reaction means 16, or formaldehyde synthesis means 17.

The invention is further illustrated by the following examples, which should not be regarded as more limiting than the appended claims. Unless otherwise noted, all percentages and/or parts are by weight.

EXAMPLE I

Settling characteristics of two coal samples in a composition of methanol and trioxane were determined. Panther Hill (Texas) lignite and Rosebud (Montana) lignite were tested with a 41.2 weight percent trioxane in methanol composition. Five grams of each crushed lignite were combined with 40 milliliters of the composition of methanol and trioxane. Each combination was ball milled for 7 hours in a ceramic jar using steel balls. Each milled sample was transferred in a bottle and was allowed to settle for two days. The Panther Hill (Texas) lignite settled to 22% solids. The Rosebud (Montana) lignite settled to 21.5% solids. The addition of water or surfactants did not affect the settling characteristics. These test show that a 20% or higher slurry of coal or similar solid fuel in a composition of 41.2 weight percent trioxane in methanol would be stable in transport.

CALCULATED EXAMPLE II

By converting the carbon of carbon dioxide and methane into the carbons of methanol and trioxane, there is a savings of energy over the prior art method of converting the carbon of methane into methanol alone. The reaction of methane and oxygen to form carbon monoxide and hydrogen, and in turn, methanol, in accordance with the following equation:

$$2CH_{4(gas)}+O_{2(gas)}\rightarrow 2CO_{(gas)}+4H_{2(gas)}\rightarrow 2CH_3OH_{(gas)}$$

is highly exothermic and wastes much of the thermal energy of methane. In effect, only one carbon monoxide per methane is produced. On the other hand, the reaction of methane and carbon dioxide to form carbon monoxide and hydrogen, Reaction (I) above, is efficient in that more than one carbon monoxide per methane is produced. This incremental carbon monoxide contains the thermal energy of methane that would be otherwise wasted in a conventional partial oxidation of methane to methanol.

For example, starting with methane and carbon dioxide at one atmosphere pressure and 298° K. and liquid water, to derive a 41.2 weight percent solution of trioxane in methanol by the above described process variation wherein the reactions of carbon monoxide and hydrogen, Reactions III and IV, occur simultaneously to form methanol and to form formaldehyde in the same reactor and the formaldehyde is trimerized to trioxane, the calculated heat of formation is 90.24 K cal $mol^{-1}$ based on consumption of one mol of methane. In English units this heat of formation amounts to 415,000 B.T.U. absorbed per thousand cubic feet of methane or 2,490,000 B.T.U. per equivalent barrel of oil. This assumes that 6000 cubic feet of methane is equivalent in energy to one barrel of crude oil. If this heat of formation can be externally derived from another source such as coal, high sulfur asphaltic oil, nuclear power, etc. the process would yield a product containing 1,394,000 B.T.U. per thousand cubic feet or 8,364,000 B.T.U. per equivalent barrel of methane. This is 415,000 B.T.U. per thousand cubic feet and 2,490,000 B.T.U. per equivalent barrel more than would be obtained from the same amount of methane by the conventional method of partial oxidation with air. If this heat is derived by combustion of methane, however, such as in Reaction XI, the saving would be 180,000 B.T.U. per thousand cubic feet or about 1.08 million B.T.U. per equivalent barrel.

The calculated heat of formation of an amount of a 41.2 percent by weight solution of trioxane in methanol corresponding to the consumption of one mol of methane, is 47.1 K cal/mol. This value assumes: (1) that the components of the feed, namely methane, carbon dioxide, oxygen and water were at standard conditions, that is at 1 atm and 298° K., and (2) that the process was carried out according to the above described variation. In this variation of the process, a portion of the methanol formed from carbon monoxide and hydrogen is reacted with oxygen to form formaldehyde, and the formaldehyde so formed is trimerized to trioxane. In other units this heat of formation amounts to 217,000 B.T.U. absorbed per thousand cubic feet or 1,302,000 B.T.U. per equivalent barrel. If this heat of formation can be derived from another source, this process would yield product containing 1,196,000 B.T.U. per thousand cubic feet or 7,176,000 B.T.U. per equivalent barrel of methane. This is 217,000 B.T.U. per thousand cubic feet and 1,302,000 B.T.U. per equivalent barrel more than would be obtained from methanol prepared from the same amount of methane by the conventional method of partial oxidation with air. If this heat, however, is derived by combustion of methane such as Reaction XI, the savings would be 180,000 B.T.U. per thousand cubic feet or 1.08 million B.T.U. per equivalent barrel.

Reasonable variations and modifications which will become apparent to those skilled in the art can be made in this invention without departing from the spirit and scope thereof.

I claim:

1. A method comprising:

(a) mixing a first stream comprising a light hydrocarbon and carbon dioxide with oxygen to form a second stream;

(b) exposing the second stream to a temperature of about 650° C. to about 1100° C. and a pressure of about 200 psi to about 600 psi in the presence of a metal oxide catalyst, thereby producing a third stream comprising carbon monoxide and hydrogen;

(c) passing the third stream through a first bed comprising a metal oxide catalyst which is maintained at a temperature of about 200° C. to about 400° C. and a pressure of about 200 psi to about 600 psi, thereby converting a first portion of the third stream to methanol;

(d) passing at least a second portion of the third stream through a second bed comprising a metal catalyst which is maintained at a temperature of about 500° C. to about 750° C. and a pressure of about 200 psi to about 600 psi, thereby converting the second portion of the third stream to formaldehyde;

(e) trimerizing, at a temperature of about 0° C. to about 200° C. and at a pressure of about 200 psi to about 400 psi, at least a portion of the formaldehyde to trioxane in the presence of the methanol to thereby produce a composition comprising methanol and trioxane.

2. A process in accordance with claim 1 wherein at least a portion of said third stream is provided by the gasification of coal.

3. A process in accordance with claim 1 wherein said catalyst used in step (b) is supported upon a catalyst base selected from the group consisting of silica, alumina, and mixtures thereof.

4. A process in accordance with claim 3 wherein said trimerization of said formaldehyde to trioxane is carried out in the presence of and in contact with an acid catalyst.

5. A process in accordance with claim 4 wherein said acid catalyst is selected from the group consisting of sulfuric acid, phosphoric acid, alkyl and aryl sulfonic acids, minerals containing acid sites and ion exchange resins containing sulfo groups.

6. A method in accordance with claim 1 wherein in steps (c) and (d) the third stream is passed through a synthesis gas reaction means having an inlet and an outlet and having the first bed near the inlet and the second bed near the outlet so that the third stream first passes through the first bed and then through the second bed, wherein a temperature gradient is maintained across the synthesis gas reaction means from the inlet to the outlet, the temperature ranging from about 200° C. at the inlet to about 750° C. at the outlet.

7. A method comprising:

(a) mixing a first stream comprising a light hydrocarbon and carbon dioxide with oxygen to form a second stream;

(b) exposing the second stream to a temperature of about 650° C. to about 1100° C. and a pressure of about 200 psi to about 600 psi in the presence of a metal oxide catalyst, thereby producing a third stream comprising carbon monoxide and hydrogen;

(c) passing the third stream through a first bed comprising a metal oxide catalyst, selected from the group consisting of copper oxide and zinc oxide, which is maintained at a temperature of about 200° C. to about 400° C. and a pressure of about 200 psi to about 600 psi, thereby converting a first portion of the third stream to methanol;

(d) passing at least a second portion of the third stream through a second bed of a metal catalyst which comprises copper, zinc, and selenium where the amount of selenium does not exceed that of zinc, wherein the second bed is maintained at a temperature of about 500° C. to about 750° C. and a pressure of about 200 psi to about 600 psi, thereby converting the second portion of the third stream to formaldehyde;

(e) trimerizing, at a temperature of about 0° C. to about 200° C. and at a pressure of about 200 psi to about 400 psi, at least a portion of the formaldehyde to trioxane in the presence of the methanol to thereby produce a composition comprising methanol and trioxane.

8. A method comprising:

(a) mixing a first stream comprising a light hydrocarbon and carbon dioxide with oxygen to form a second stream;

(b) exposing the second stream to a temperature of about 650° C. to about 1100° C. and a pressure of about 200 psi to about 600 psi in the presence of a metal oxide catalyst, thereby producing a third stream of synthesis gas comprising carbon monoxide and hydrogen;

(c) passing the third stream through a synthesis gas reaction means, having an inlet and an outlet, which is maintained at a pressure of about 200 psi to about 600 psi and across which a temperature gradient is maintained with the temperature being about 200° C. at the inlet and about 750° C. at the outlet, wherein said means has a first bed, near the inlet, comprising a metal oxide catalyst selected from the group consisting of copper oxide and zinc oxide, and a second bed, near the outlet, comprising a metal catalyst comprising copper, zinc, and selenium where the amount of selenium does not exceed that of zinc, whereby flow of the third stream through the first bed converts a first portion of the third stream to methanol and flow of the third stream through the second bed converts a second portion of the third stream to formaldehyde, and further wherein a third unreacted portion of the third stream flows from the outlet of said means after passing through the first bed and second bed without being converted to either methanol or formaldehyde;

(d) recycling the third unreacted portion of the third stream through said synthesis gas reaction means to form additional formaldehyde and methanol;

(e) trimerizing, at a temperature of about 0° C. to about 200° C. and at a pressure of about 200 psi to about 400 psi, at least a portion of the formaldehyde to trioxane in the presence of the methanol and in contact and an acid catalyst selected from the group consisting of sulfuric acid, phosphoric acid, alkyl and aryl sulfonic acids, minerals containing acid sites, and ion exchange resins containing sulfo groups, whereby a composition comprising methanol and trioxane is produced.

* * * * *